US009090068B2

(12) United States Patent
Hashimoto et al.

(10) Patent No.: US 9,090,068 B2
(45) Date of Patent: Jul. 28, 2015

(54) CAPPING DEVICE AND LIQUID EJECTING APPARATUS

(75) Inventors: Naoyoshi Hashimoto, Kariya (JP); Takeo Seino, Nagano (JP); Taisuke Yamamoto, Nagano (JP); Hirokazu Ono, Sawa (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 13/324,404

(22) Filed: Dec. 13, 2011

(65) Prior Publication Data

US 2012/0154484 A1 Jun. 21, 2012

(30) Foreign Application Priority Data

Dec. 16, 2010 (JP) ..... 2010-280402
Dec. 27, 2010 (JP) ..... 2010-289497

(51) Int. Cl.
*B41J 2/165* (2006.01)

(52) U.S. Cl.
CPC ..... *B41J 2/16508* (2013.01); *B41J 2/16523* (2013.01)

(58) Field of Classification Search
None
See application file for complete search history.

(56) References Cited

U.S. PATENT DOCUMENTS

| | | | | |
|---|---|---|---|---|
| 7,244,260 | B2 * | 7/2007 | Koseki | 606/148 |
| 7,651,184 | B2 | 1/2010 | Nakamura et al. | |
| 2008/0049065 | A1 * | 2/2008 | Morikoshi | 347/33 |
| 2008/0088666 | A1 * | 4/2008 | Shindo et al. | 347/30 |
| 2010/0045733 | A1 | 2/2010 | Mano | |

FOREIGN PATENT DOCUMENTS

| | | |
|---|---|---|
| JP | 10-175306 | 6/1988 |
| JP | 06-008457 | 1/1994 |
| JP | 09-239997 | 9/1997 |
| JP | 2004-188904 | 7/2004 |
| JP | 2010-046854 | 3/2010 |

* cited by examiner

*Primary Examiner* — Alejandro Valencia
(74) *Attorney, Agent, or Firm* — Workman Nydegger

(57) ABSTRACT

There is provided a capping device having a bottomed box-shaped cap having an opening at one of ends of short side walls and long side walls formed in a ring shape and a bottom portion on the other side, the bottom portion is formed with a waste liquid disposal port configured to discharge liquid flowed therein from the opening and a rib extended so as to connect two opposing wall surfaces of the long side walls at a position overlapping at least partly with the waste liquid disposal port two-dimensionally when viewed from the side of the opening, and the rib including a communication hole configured to penetrate in the width direction intersecting the direction of extension of the rib and communicate with the waste liquid disposal port.

18 Claims, 14 Drawing Sheets

CAPPING DEVICE AND LIQUID EJECTING APPARATUS

CROSS REFERENCES TO RELATED APPLICATIONS

The entire disclosure of Japanese Patent Application Nos. 2010-280402, filed Dec. 16, 2010, 2010-289497, filed Dec. 27, 2010 are expressly incorporated by reference herein.

BACKGROUND

1. Technical Field

The present invention relates to a capping device and a liquid ejecting apparatus having the capping device.

2. Related Art

In the related art, an ink jet printer which performs printing by ejecting ink from nozzles opening on a nozzle-formed surface of a liquid ejecting head onto a medium such as a paper is widely known as a type of liquid ejecting apparatus.

In such an ink jet printer, nozzle clogging may occur by an increase in viscosity of ink due to evaporation of water content or volatile components of ink accumulated in the nozzles or foreign substances such as air bubbles or metal particles may enter into the nozzles. Then, when clogging of the nozzles or entry of foreign substances into the nozzles occurs, printing failure such that the direction of ejection of ink may be deviated, or a proper amount of ink cannot be ejected from the nozzles may result.

Therefore, in the ink jet printer, a cleaning process for cleaning the nozzles is performed. For example, an opening of a cap is brought into abutment with a nozzle-formed surface, a closed space between the interior of the cap and the nozzle-formed surface formed thereby is vacuumed by driving a suction pump to suck ink in the nozzles, which causes clogging, into the cap. Then, the sucked ink is discharged to the outside from a waste liquid disposal port provided on the cap through the suction pump. Alternatively, the ink in the nozzles, which causes clogging, is discharged into the cap by forcedly ejecting ink from the nozzles. Then, the discharged ink is discharged to the outside from the waste liquid disposal port provided on the cap through the suction pump.

There is a case where an ink absorber is provided in the cap so that the ink is stable received into the cap without flying apart at this time. In such a case, the ink may remain in the ink absorber after the cleaning process of the nozzles has performed. Then, if the remaining ink is in a state of being increased in viscosity when a closed space is formed in the cleaning process, the ink increased in viscosity absorbs water content from the ink in the nozzle, and may cause the viscosity of the ink in the nozzles to increase. Therefore, a technology of reducing the amount of ink remaining in the cap by the ink absorber having a non-dense portion on the side of the waste liquid disposal port is proposed in JP-A-10-175306.

The technology proposed in JP-A-10-175306 has a risk of a reduction of the ink absorbing amount which can be received in the ink absorber having the non-dense portion. Therefore, it is effective to increase the ink absorbing amount of the ink absorber, that is, to increase the ink receiving amount in the cap without using the ink absorber having the non-dense portion. As a method, it is effective to design the cap to have a deeper bottom so as to have a longer distance from the opening thereof. The reason is that an opening area of the opening of the cap is limited according to the nozzle-formed surface which comes into abutment thereto.

When the cap is designed to have the deeper bottom portion, the height of an annular side wall formed between the opening portion and the bottom portion, that is, the dimension between a proximal end portion on the bottom portion side and a distal end portion which is also the opening is increased. Therefore, when the cap is manufactured by a molding process, there may arise an inwardly inclining phenomenon that the distal end portion (opening portion) of the side wall is inclined toward each other due to manufacturing reasons. Therefore, unfavorable deformation such as distortion of the shape of the opening or reduction of surface area of the opening may arise. In order to avoid this phenomenon, there is a method of forming a rib extending upright to have a predetermined height on the bottom portion so as to connect the side walls which are subject to the inclination of the distal end portion. In this configuration, since the rib is formed on the side of the bottom portion, the inward inclination of the distal end portion can be inhibited without reducing the surface area of the opening.

However, when the rib which connects the side walls is formed on the bottom portion of the cap, the cap is divided into two areas on the side of the bottom portion thereof. Therefore, formation of the waste liquid disposal port in each of these two areas is needed, so that there arises a problem in that the structure of the cap becomes complicated.

SUMMARY

An advantage of some aspects of the invention is that there is provided a capping device having a cap formed with a rib on a bottom portion thereof, in which increase in number of waste liquid disposal ports is inhibited.

Another advantage of some aspects of the invention is that there is provided a liquid ejection apparatus having the capping device as described above.

There is provided a capping device including: a bottomed box-shaped cap having an opening at one end of a side wall formed into a ring shape and a bottom portion at the other end, the bottom portion including a waste liquid disposal port configured to discharge liquid flowed therein from the opening, a rib extending so as to connect two opposing wall surfaces of the side wall at a position overlapping at least partly with the waste liquid disposal port two-dimensionally when viewed from the side of the opening, and the rib including a communicating hole configured to penetrate in the width direction intersecting the direction of extension of the rib and communicate with the waste liquid disposal port.

In this configuration, since the inflow liquid can be discharged to the waste liquid disposal port via the communicating hole from both sides of the rib, the liquid flowed into the two spaces divided by the single rib in the cap can be discharged through the single waste liquid disposal port. Therefore, the configuration relating to the waste liquid disposal is simplified. Also, since the rib connects the side walls, a phenomenon that the side walls incline inward at the time of the molding process can be inhibited.

Preferably, the waste liquid disposal port has a diameter at least larger than or the same as the dimension of the rib in the width direction.

In this configuration, a communicating hole can be formed easily with the waste liquid disposal port by the molding process at a position overlapped two-dimensionally with the rib on the side of the bottom portion of the rib.

Preferably, the capping device further includes a liquid absorber accommodated in the cap and formed with a slit by incising a position corresponding to the rib.

In this configuration, the position of accommodation of the liquid absorber in the longitudinal direction in the cap can be fixed by the rib inserted into the slit. Therefore, since the liquid absorber can be inserted into an adequate position in the cap by the slit, the probability that the liquid is discharged to the waste liquid disposal port is increased.

Preferably, the slit is provided to have a width not exceeding the width of the rib.

In this configuration, when the liquid absorber is inserted into the cap, even when there is a positional displacement between the slit and the rib, the probability that the rib is positioned within the width of the slit is increased, so that the ink absorber can be inserted adequately into the cap. Also, by the rib inserted into the slit, the slit portion of the liquid absorber comes into abutment with the rib in a compressing state from the both sides in the width direction even after the insertion, the position of the liquid absorber after the insertion is maintained stably.

Preferably, the liquid absorber is provided with a cut-shaped portion cut into a triangular shape at an end portion where the incision of the slit is started.

In this configuration, when the liquid absorber is inserted into the cap, even when there is the positional displacement between the slit and the rib, the probability that the rib is positioned within the width of a cut-shaped portion of the slit is increased, so that the ink absorber can be inserted adequately into the cap.

Preferably, the liquid absorber is provided with a rectangular cut-shaped portion having a width not smaller than the width of the rib at an end portion on the side of terminal of the incision of the slit.

For example, when the liquid absorber is inserted into the cap, even when there is a positional displacement between the slit and the rib, the rib is pushed toward the opening once, thereby deforming the liquid absorber. Accordingly with this configuration, since the probability that the deformation of the ink absorber is released is increased by the pushed rib then positioned in the width of the cut-shaped portion, the liquid absorber can be inserted adequately into the cap.

Preferably, the bottom portion includes a second bottom portion having a portion farthest from the opening and a first bottom portion formed of a portion closer to the opening than the second bottom portion, and the rib is provided at a farthest portion from the opening on the second bottom portion.

In this configuration, the receiving amount of liquid which flows into the cap can be increased by providing the second bottom portion which is deeper than the first bottom portion, and the inward inclination of the side walls can be inhibited from a proximal end side by extending the rib at the farthest portions from the opening. Also, the liquid flowed into the second bottom portion can be guided reliably to the waste liquid disposal port formed at a position where the rib is extended, and be discharged therefrom.

Preferably, the second bottom portion is formed between two of the first bottom portions formed apart from each other, and inclined surfaces are formed respectively between the second bottom portion and two of the first bottom portions so that the distance therebetween is decreased toward the second bottom portion.

In this configuration, when inserting the liquid absorber to the second bottom portion for example, the liquid absorber is guided toward the center of the second bottom portion by the respective inclined surfaces. Therefore, since the liquid absorber can be guided toward the waste liquid disposal port formed at the position where the rib is extended, the probability that the liquid is discharged is increased.

A liquid ejecting apparatus according to a second aspect of the invention is provided with a liquid ejection head configured to eject liquid to a medium and the capping device having the configurations described above.

In this configuration, the liquid flowed toward the bottom portion partitioned into two spaces by the single rib in the cap can be discharged through the single waste liquid disposal port, so that the liquid ejecting apparatus having a simple configuration relating to the waste liquid disposal is obtained.

Preferably, the capping device includes a communicating port to which a vacuum unit configured to vacuum the interior of the cap is connected and which communicates the interior of the cap with outside air out of the cap, and a check valve formed on a surface which forms the cap and configured to inhibit a movement of the liquid from the interior of the cap to the outside air via the communicating port and allows the movement of air from the outside air to the interior of the cap via the communicating port after the interior of the cap has vacuumed by the vacuum unit.

In this configuration, since the liquid in the cap can be prevented from flowing out of the area of the cap via the communicating port, for example, inflow of liquid into piping connected to the communicating port for a relief to the atmospheric air can be inhibited. Also, since the air can be flowed into the area in the cap after the cap has been vacuumed, the cap can be relieved to the atmospheric air.

Preferably, the check valve includes a fixed portion fixed to the cap and a movable portion displaced between a covered position covering and closing the communicating port from the inside of the cap and an open position away from the covered position and opening the communicating port.

In this configuration, the check valve having a simple structure which occupies a little volume in the portion of the cap where the communicating port is formed is obtained. Therefore, inflow of liquid into the piping for the relief to the atmospheric air can be reliably inhibited while inhibiting the reduction of the area of the cap which is a spatial area which receives the ink.

Preferably, the capping device further includes a cap seal portion which comes into abutment with the liquid ejection head and the check valve is formed of the same material as the cap seal portion.

In this configuration, for example, when the cap seal portion is molded by the molding process, the cap seal portion can be formed simultaneously with the check valve.

Preferably, the check valve has a shape continuing from the cap seal portion.

In this configuration, for example, when the cap seal portion and the check valve are formed simultaneously by injection molding process, a gate for ejection can be used commonly.

Preferably, the check valve is positioned in the direction opposite from the direction of gravitational force with respect to the waste liquid disposal port.

In this configuration, since the liquid in the cap flows toward the waste liquid disposal port positioned in the direction of gravitational force with respect to the check valve, the probability that the liquid stays in the periphery of the check valve is lowered. Therefore, inflow of liquid into the piping connected to the communicating port for the relief to the atmospheric air can be reliably inhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
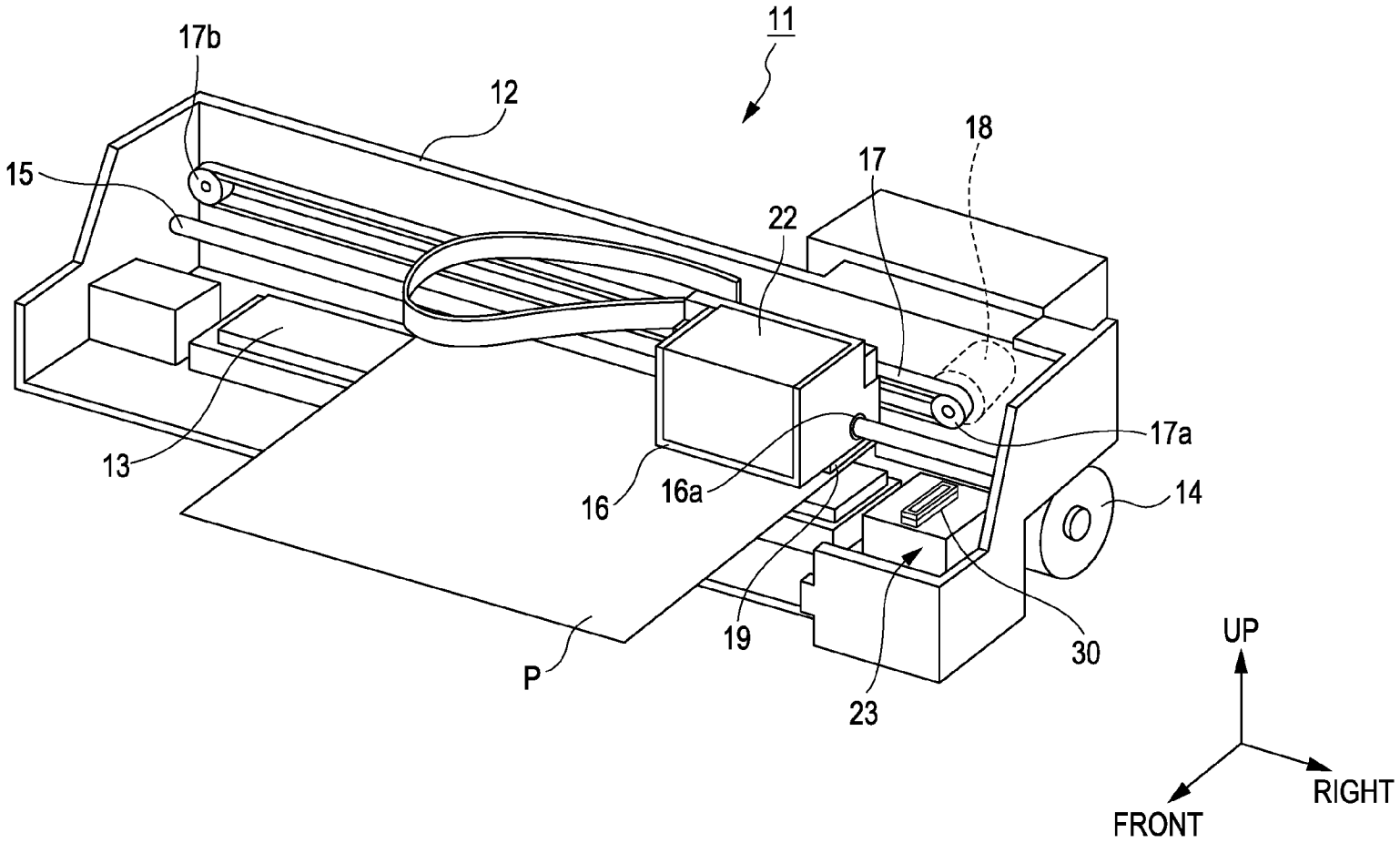
FIG. 1 is a perspective view showing a schematic configuration of a printer having a capping device according to an embodiment of the invention.

Referring now to the drawings, embodiments in which the invention is implemented in an ink jet printer, which is a type of a liquid ejection apparatus having a head maintenance mechanism will be described. In order to facilitate the description given below, a direction of gravitational force in the vertical direction is defined as a downward direction, a direction opposite from the direction of the gravitational force is defined as an upward direction as shown in the drawings. Also, a direction intersecting these directions, which is a direction of transport in which a paper P fed to the printer is transported when forming an image is defined as front, and a direction opposite from the direction of transport is defined as rear. Furthermore, directions intersecting both the direction of the gravitational force and the direction of transport in which a carriage 16 moves reciprocally, that is, a scanning direction, is referred to as right and left respectively, when viewed from the front.

As shown in FIG. 1, an ink jet printer 11 (hereinafter, also referred to simply as "printer 11") includes a substantially rectangular box-shaped frame 12, and a supporting base 13 is provided so as to extend along the left and right direction, which is a longitudinal direction, at a lower portion in the frame 12. Also, a paper feed motor 14 is provided at a lower rear portion in the frame 12. By driving of the paper feed motor 14, the paper P is fed from the rear side thereof onto the supporting base 13 by a paper feeding mechanism, not shown.

A the supporting base 13 in the frame 12, a guide shaft 15 is provided so as to extend along the left and right direction, which is the longitudinal direction of the supporting base 13. The guide shaft 15 supports a carriage 16 so as to be capable of moving reciprocally in an axial direction thereof. More specifically, the carriage 16 is formed with a supporting hole 16*a* penetrating therethrough in the left and right direction, and the guide shaft 15 is inserted through the supporting hole 16*a*.

A drive pulley 17*a* and a driven pulley 17*b* are rotatably supported respectively at positions in the vicinity of both ends of the guide shaft 15 on an inner surface of a rear wall of the frame 12. An output shaft of a carriage motor 18 is coupled to the drive pulley 17*a*, and an endless timing belt 17 coupled partly to the carriage 16 is stretched around the drive pulley 17*a* and the driven pulley 17*b*. The ink jet printer 11 has a structure in which the carriage 16 can be reciprocally moved in the left and right direction while being guided by the guide shaft 15 via the timing belt 17 by driving the carriage motor 18.

A liquid ejecting head 19 is provided on the lower surface of the carriage 16. The liquid ejecting head 19 is provided with a plurality of nozzles 20 (see FIG. 2) for ejecting ink. A nozzle plate 19*a* is attached to a lower end of the liquid ejecting head 19. The nozzle plate 19*a* is formed with opening holes of the respective nozzles 20. In contrast, an ink cartridge 22 for supplying ink to the liquid ejecting head 19 is demountably mounted to the carriage 16.

Then, in the ink jet printer 11, for example, pressure generating mechanisms 21 (see FIG. 2) having a piezoelectric element are provided on the liquid ejecting head 19. By driving the pressure generating mechanisms 21, a printing operation such as supplying ink in the ink cartridge 22 into the liquid ejecting head 19, and ejecting the ink onto the paper P fed from the respective nozzles 20 of the liquid ejecting head 19 (see FIG. 2) onto the supporting base 13 is performed.

In an area on the right side of the supporting base 13 in the interior of the frame 12, that is, in an area which is not used during a printing operation (home position area) is provided with a maintenance mechanism 23 configured to perform maintenance such as cleaning of the liquid ejecting head 19 or the like. In the printer 11, the liquid ejecting head 19 is moved to the home position area periodically, and the maintenance mechanism 23 is activated, so that a process of cleaning the liquid ejecting head 19 (the nozzles 20) (cleaning process) is performed.

Figure 2:
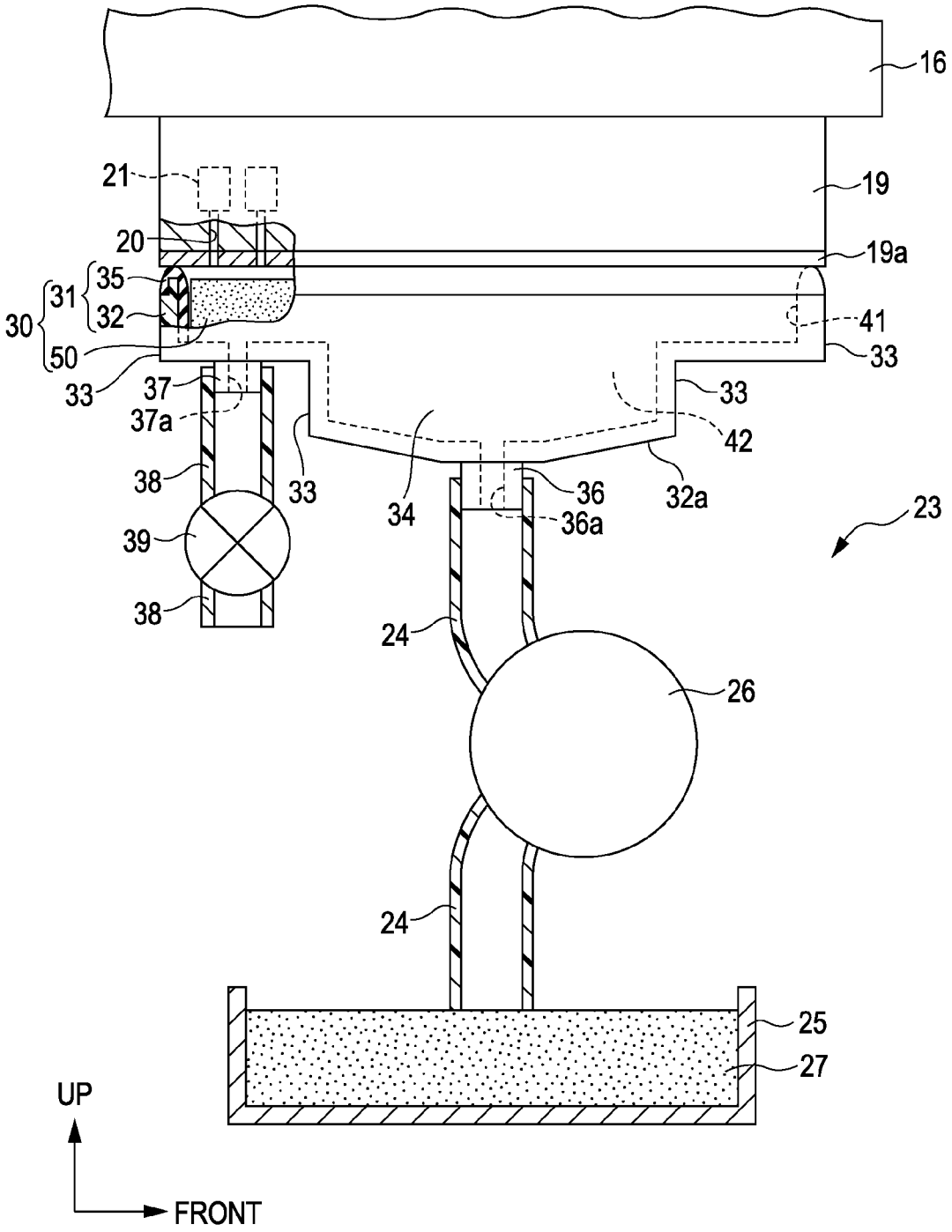
FIG. 2 is a functional configuration drawing showing a maintenance mechanism having the capping device according to the embodiment.

Subsequently, an outline of the maintenance mechanism 23 will be described with reference to FIG. 2. As shown in FIG. 2, the maintenance mechanism 23 includes a capping device 30 having a cap 31 and an ink absorber 50 as the liquid absorber.

The cap 31 includes a resin-made cap body 32 having a bottomed box shape, and a cap seal portion 35 formed of a softer material than that of the cap body 32 (rubber material, elastomer, or the like) into a square ring shape at an opening, which is an upper side of the cap body 32 which comes into abutment with the liquid ejecting head 19. The ink absorber 50 is formed of a porous material which absorbs ink and is inserted into an internal space of the cap 31.

The cap body 32 includes a pair of front and rear short side walls 33 extending in a short direction and formed into a stair-like pattern in symmetry when viewed in the left and right direction, a pair of left and right long side walls 34 extending in a longitudinal direction and formed into a parallel vertical flat panel shape in the left and right direction, and a bottom wall 32*a* which connects a lower end edges of the short side walls 33 and the long side walls 34. The cap 31 is defined by the short side walls 33, the long side walls 34, and the bottom wall 32*a* formed into a ring shape so as to surround the opening, so that a first space 41 extending downward from the opening and a second space 42 extending downward further therefrom are formed so as to be stacked one on top of another in the interior of the cap 31. An area including the first space 41 and the second space 42 combined to each other corresponds to a closed spatial area formed when the cap 31 comes into abutment with the liquid ejecting head 19. The first space 41 and the second space 42 then corresponds to a spatial area which can receive ink ejected or sucked from the liquid ejecting head 19. In this embodiment, the second space 42 has a shape narrowed evenly in a fore-and-aft direction with respect to the first space 41, and is positioned at a substantially center in the fore-and-aft direction with respect to the first space 41.

Formed on the bottom wall 32*a* of the cap body 32 is a cylindrical column-shaped discharge liquid portion 36 projecting downward at a lowest portion of the second space 42. The discharge liquid portion 36 is formed with a waste liquid disposal port 36*a* which communicates the interior and the exterior of the second space 42 by penetrating therethrough in the vertical direction. The discharge liquid portion 36 is connected to a waste ink tank 25 via a discharge tube 24. A suction pump 26 for sucking ink (or air) in the interior of the cap 31 and discharging the same into the waste ink tank 25 is provided at a midpoint of the discharge tube 24. A waste ink absorbing member 27 configured to absorb and hold ink is accommodated in the interior of the waste ink tank 25.

The cap body 32 is also formed with a column-shaped air intake portion 37 projecting downward at a lower portion (more specifically, at a horizontal portion of the long side walls 34 on the rear end side) of the first space 41 positioned on one side (rear end side in FIG. 2) in the fore-and-aft direction with respect to the second space 42. The air intake portion 37 is formed with an air intake port 37*a* as a communication port which communicates the interior and the exterior of the first space 41 by penetrating therethrough in the vertical direction. An air intake tube 38 provided with an atmospheric relief valve 39 at a midpoint thereof is connected to the air intake portion 37. Then, the closed space in the cap 31 (the first space 41 and the second space 42) is opened toward the atmosphere by the communication of the first space 41 (and hence the second space 42) with the atmospheric air (outside air) out of the area of the closed space via the air intake tube 38 by an opening action of the air intake tube 38.

In the maintenance mechanism 23, the cap 31 is disposed so that an opening of the cap 31 takes a position opposing a lower surface of the nozzle plate 19*a* of the liquid ejecting head 19 at a distance to some extent when the liquid ejecting head 19 is moved to the home position area. Then, the cap 31 is risen upward by an elevating mechanism (not shown) provided in the maintenance mechanism 23, so that the cap seal portion 35 formed on the opening comes into abutment with the liquid ejecting head 19 so as to surround the opening holes of the respective nozzles 20 and achieves capping.

When the suction pump 26 is driven in this abutted state, fluid (air) in the cap 31 is sucked, and the pressure in the space partitioned by the lower surface of the nozzle plate 19*a* and the cap 31 is lowered (vacuumed). Therefore, ink in the respective nozzles 20 is sucked by a negative pressure (a pressure lower than the atmospheric pressure) generated thereby and is discharged into the cap 31. Furthermore, the ink in the cap 31 is discharged into the waste ink tank 25 via the waste liquid disposal port 36*a* and the discharge tube 24. The cleaning process of the same nozzles 20 is performed by forcedly discharging ink in the nozzles 20 in this manner.

The atmospheric relief valve 39 is originally closed during the cleaning process, and after the cleaning process has completed, the atmospheric relief valve 39 is opened and the space in the cap 31 is brought into the equivalent pressure as the atmospheric pressure. Accordingly, the cap 31 is configured to be capable of moving downward away from the liquid ejecting head 19 easily.

Although the description is omitted, the maintenance mechanism 23 is provided with a mechanism that wipes off unnecessary ink adhered to the nozzle plate 19*a* for example, a liquid receiving container that receives ink ejected forcedly from the nozzles and the like as needed in this embodiment.

The capping device 30 provided in the maintenance mechanism 23 includes the second space 42 on the downside of the first space 41, and only the single waste liquid disposal port 36*a* in the second space 42 as described above. In other words, in this embodiment, the capping device 30 is configured in such a manner that an ink absorbing amount is increased by providing the second space 42 on the down side of the first space 41, while the above-described problem of the related art is resolved by providing only one waste liquid disposal port. Referring now to FIG. 3A to FIG. 5D, the cap 31 and the ink absorber 50 which constitute the capping device 30 in this embodiment will be described in detail below.

Figure 3A:
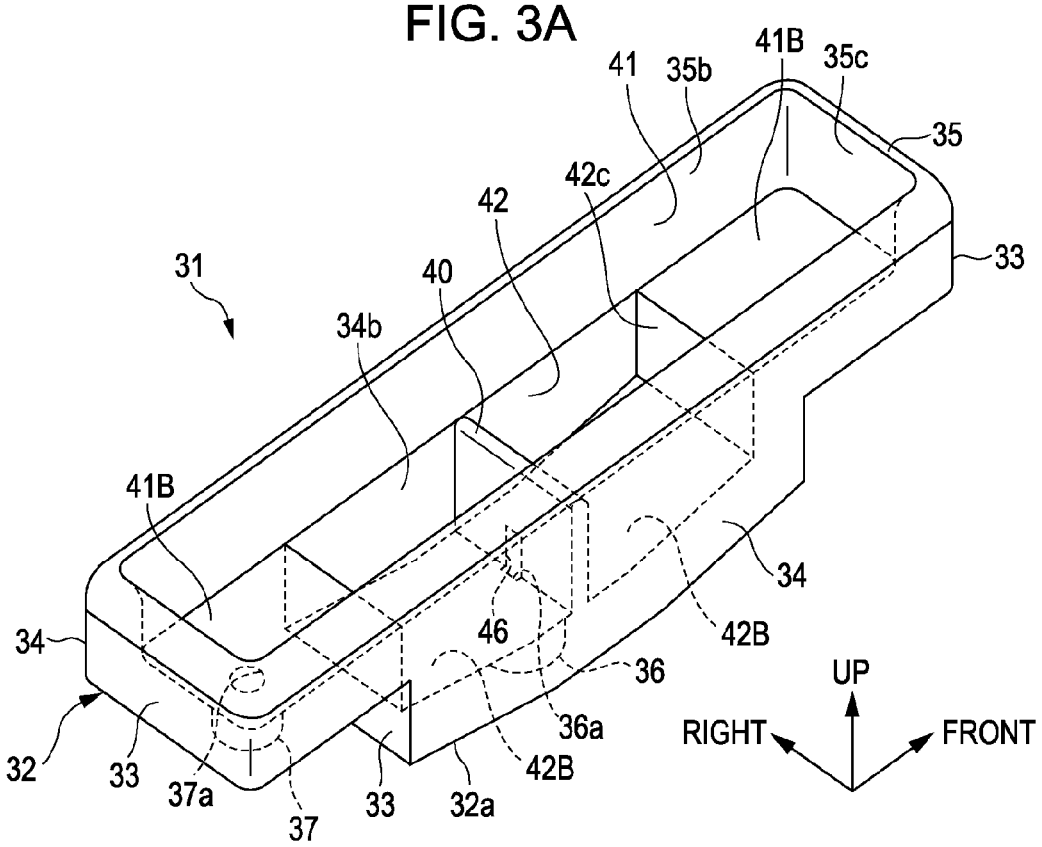
FIG. 3A is a perspective view of a cap according to the embodiment.
Figure 3B:
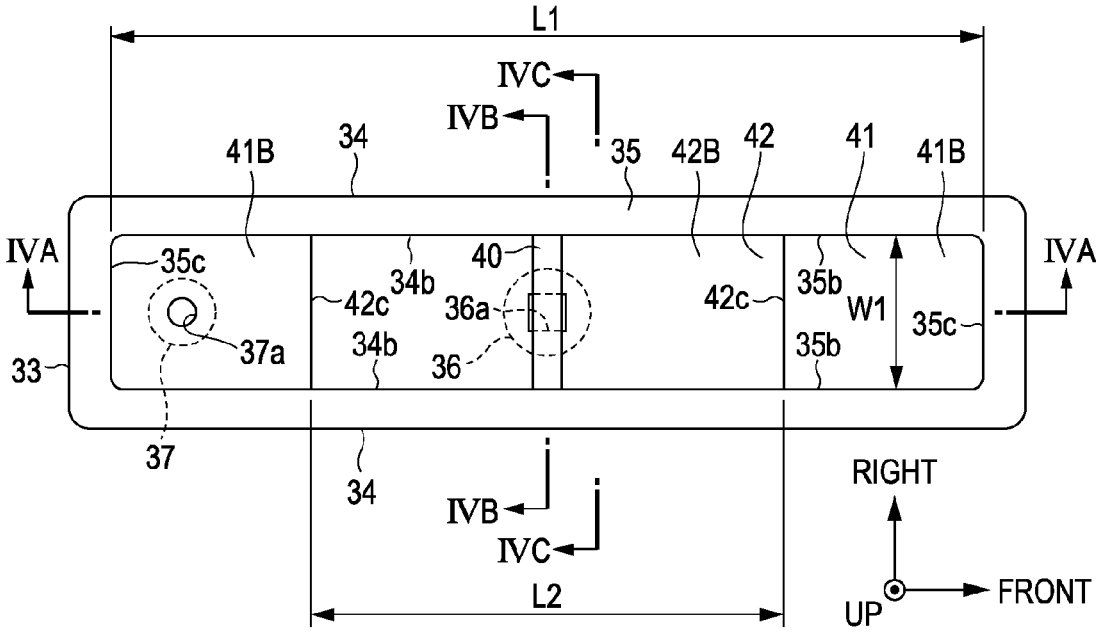
FIG. 3B is a plan view of the cap according to the embodiment.

The cap 31 in this embodiment has a shape including two, small and large, substantially parallelepiped shapes having different lengths in the longitudinal direction (fore-and-aft direction) stacked one on top of another in the vertical direction as shown in FIG. 3A showing the cap 31 viewed in an oblique direction, and FIG. 3B showing the cap 31 viewed from above.

In the cap body 32, a pair of the front and rear short side walls 33 are formed so that an inner surface of the cap 31 of each of the short side walls 33 is formed into a stair-like shape having two vertical wall surfaces apart from each other in the fore-and-aft direction and a horizontal floor surface connecting a lower end of one of the two vertical wall surfaces and an upper end of the other vertical wall surface. Also, a pair of the left and right long side walls 34 are each formed to have an inner surface of the cap 31 having a substantially T-shaped vertical wall surface when viewed in the left and right direction. Then, the bottom wall 32*a* formed with the discharge liquid portion 36 so as to project therefrom is formed into a rectangular shape in plan view.

In addition, in this embodiment, the square ring-shaped cap seal portion 35 is provided at an upper end portion of the cap body 32 as described above. Then, the cap seal portion 35 includes long pending wall portions 35*b* pending inward of the cap body 32 while extending along the longitudinal direction of the cap body 32 (see FIG. 4B), and short pending wall portions 35*c* pending inward of the cap body 32 while extending along the short side of the cap body (see FIG. 4A). Then, the long pending wall portions 35*b* are formed to come into tight contact with the inner surfaces of the long side walls 34 and the short pending wall portions 35*c* are formed to come into tight contact with the inner surfaces of the short side walls 33, respectively. In this embodiment, the cap seal portion 35 is formed by, so-called a two-color molding, which is molded as a secondary side after the cap body 32 has molded as a primary side.

Consequently, the cap 31 is formed with the rectangular opening having a length L1 in the longitudinal direction, and a width W1 in the short direction by a pair of the left and right long pending wall portions 35*b* and a pair of the front and rear short pending wall portions 35*c* of the cap seal portion 35. Also, the first space 41 having the length L1 and the width W1 is formed on the side of the opening in the interior of the cap 31 by the pair of left and right long pending wall portions 35*b* and the pair of front and rear short pending wall portions 35*c*, and respective horizontal floor surface of the pair of front and rear short side walls 33. Since the horizontal floor surfaces of the short side walls 33 corresponds to the bottom portion of the first space 41, it is referred to as a first bottom portion 41B (see FIGS. 3A and 3B).

Furthermore, formed on the downside of the first space 41 is the second space 42 defined by inner surfaces of vertical wall surfaces 42*c* on the down side of the short side walls 33, inner wall surfaces 34*b* of the long side walls 34, and the bottom wall 32*a*, which is narrower than the first space 41 evenly in the fore-and-aft direction. Therefore, since the inner surface of the bottom wall 32*a* of the cap body 32 corresponds to a bottom portion of the second space, this is referred to as a second bottom portion 42B (see FIGS. 3A and 3B). In this embodiment, the second space 42 has a length L2, which is about a half the length L1 of the first space 41 in the fore-and-aft direction, and has the width W1, which is the same as that of the first space 41 in the left and right direction.

Incidentally, the cap 31 of this embodiment is provided with a rib 40 extending upright in the vertical direction at a substantially center portion of the second bottom portion 42B in the fore-and-aft direction, and extending in the short direction intersecting the longitudinal direction, that is, in the left and right direction. In other words, the rib 40 is formed so as to couple between two portions on the inner surfaces of the pair of the long side walls 34, that is, the two inner wall surfaces 34*b* opposing in the left and right direction. Therefore, the second space 42 is brought into a state of being partitioned into two spatial areas in the fore-and-aft direction by the rib 40. Then, formed on the bottom wall 32*a* of the cap body 32 is the waste liquid disposal port 36*a* so as to overlap with the rib 40 two-dimensionally in top view. In other words, the rib 40 is disposed so as to overlap with the waste liquid disposal port 36*a* two-dimensionally when viewed from the side of the opening. Then, the rib 40 is provided with a communicating hole 46 opening on both side surfaces of the rib 40 in the width direction (fore-and-aft direction) intersecting the direction of extension thereof so as to penetrate therethrough, and communicating both of the second spaces 42 partitioned into two areas by the rib 40 with the waste liquid disposal port 36*a*. The air intake port 37*a* is provided so as to open in one (rear side in this embodiment) of two parts of the first bottom portion 41B.

Figure 4A:
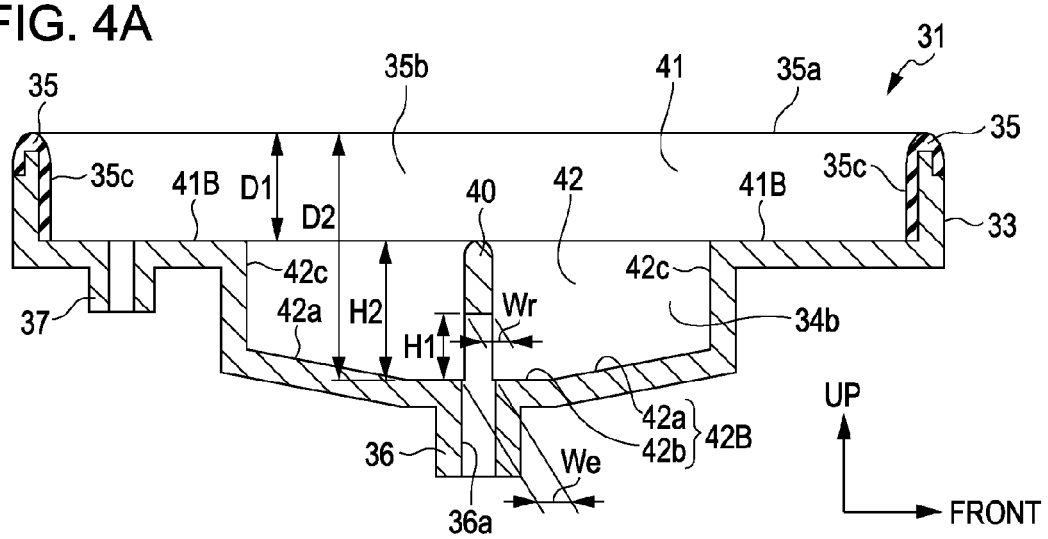
FIG. 4A is a cross-sectional view taken along the line IVA-IVA in FIG. 3B.
Figure 4B:
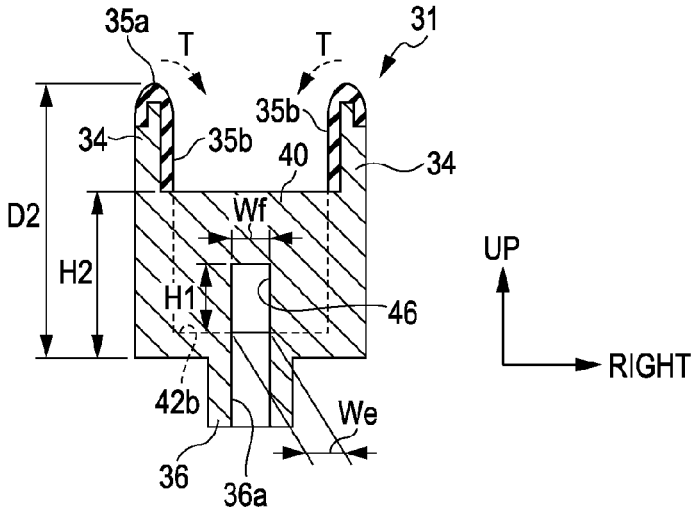
FIG. 4B is a cross-sectional view taken along the line IVB-IVB in FIG. 3B.
Figure 4C:
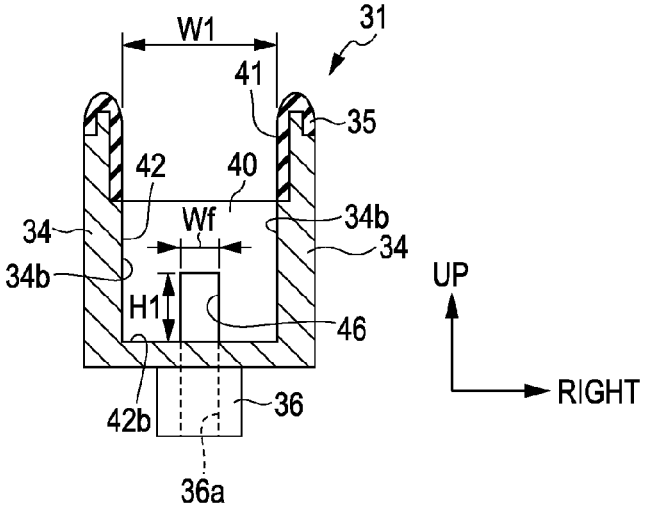
FIG. 4C is a cross-sectional view taken along the line IVC-IVC in FIG. 3B.

Referring now to FIGS. 4A, 4B, and 4C, the shape of the rib 40 will be described in detail.

As shown in FIGS. 4A, 4B, and 4*c*, in this embodiment, the cap 31 has portions apart downward by a maximum dimension D2 from an opening end 35*a* of the opening, which is an upper end of the cap seal portion 35, that is, farthest portions 42*b*, at about the center portion of the second bottom portion 42B.

Then, in order to allow easy flow of the ink toward farthest portions 42*b*, inclined surface portions 42*a* formed with inclined surfaces inclining upward in the fore-and-aft direction are formed continuously to the farthest portions 42*b* in the second bottom portion 42B.

The second space 42 is defined by the vertical wall surfaces 42*c* on the lower side of the pair of fore-and-aft short side walls 33, and the inner wall surfaces 34*b* of the pair of left and right long side walls 34 formed into a ring shape continuously with each other with respect to the second bottom portion 42B formed with the farthest portions 42*b* and the inclined surface portion 42*a*.

Consequently, the long side walls 34 are formed with a plate-shaped portion having substantially the maximum length D2 in the vertical direction at a center portion of the second space 42 in the fore-and-aft direction. Therefore, when manufacturing the cap body 32, for example, by a molding process, as shown by an arrow T in a broken line in FIG. 4B, an inwardly inclining phenomenon such that the upper end sides of the long side walls 34 existing at the positions of the farthest portions 42*b* in the fore-and-aft direction are inclined inward after the molding tends to occur.

Therefore, in this embodiment, the rib 40 having a predetermined width in the fore-and-aft direction is formed to have a height H2 in the upward direction from the farthest portions 42*b* of the second bottom portion 42B. The height H2 of the rib 40 is set to an optimal dimension within a range which does not divide the ink absorber 50 to be inserted into the cap 31 into two parts and can inhibit the inwardly inclining phenomenon of the long side walls 34. In this embodiment, the height H2 has the same dimension as the height of the first bottom portion 41B apart downward from the opening end 35*a* by a distance D.

As shown in FIGS. 4B and 4C, the rib 40 is formed with the communicating hole 46 opening on the both side surfaces of the rib 40 in the fore-and-aft direction and penetrating therethrough on the side of the second bottom portion 42B at almost the center portion thereof in the left and right direction. The communicating hole 46 is formed with the waste liquid disposal port 36*a* on the lower side thereof, and the communicating hole 46 and the waste liquid disposal port 36*a* are in communication because the respective through spatial portions thereof are continuously adjacent to each other. The communicating hole 46 is, in other words, a spatial portion arranged between the rib 40 and the waste liquid disposal port 36*a*. The communicating hole 46 is formed to have a height H1 upward from the farthest portions 42*b*.

In this embodiment, the height H1 of the communicating hole 46 is formed to have a height substantially half the height H2 of the rib 40. The height H1 is set to an optimal height so that the ink absorber 50 inserted into the cap 31 is reliably inserted into the cap 31 at a portion to be inserted into the second space 42. Therefore, the height H1 of the communicating hole 46 is not necessarily limited to substantially half the height H2 of the rib 40, and may be higher or lower than the half the height H2.

In this embodiment, a width Wr of the rib 40 in the fore-and-aft direction and a width Wf of the communicating hole 46 in the left and right direction at the height H1, which corresponds to the upper end of the communicating hole 46, are set to have the same dimension. Also, the width of the rib 40 in the left and right direction is the same as the dimension of a gap between the inner wall surfaces 34*b* of the long side walls 34 and, in this embodiment, is formed to be the width W1 which is the same as the dimension of a gap between the long pending wall portions 35*b* of the cap seal portion 35.

In contrast, the waste liquid disposal port 36*a* is formed to have a width We having the same diameter in the fore-and-aft direction and the left and right direction at the farthest portions 42*b* communicating with the communicating hole 46. Then, although not described in detail here, on the basis of a die structure for forming the rib 40 and the waste liquid disposal port 36*a*, the width We is set to be at least the same dimension (preferably, a dimension larger than the width Wr) as the fore-and-aft width Wr of the rib 40 in the fore-and-aft direction in which at least the dies come into abutment with each other into a state of meeting together.

Figure 5A:
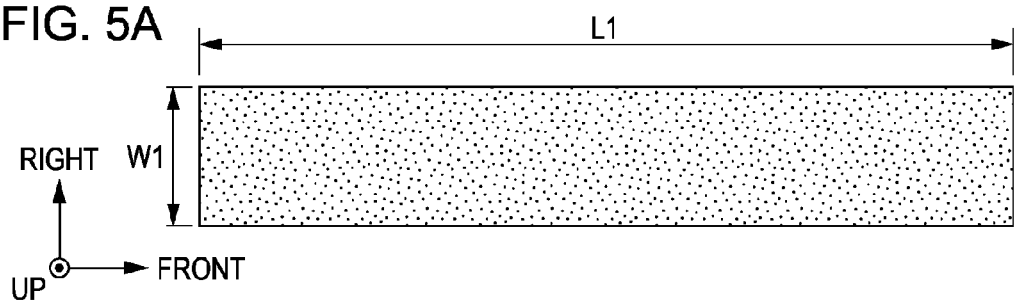
FIG. 5A is a plan view of a liquid absorber according to the embodiment.

Subsequently, referring now to FIGS. 5A to 5D, the ink absorber 50 to be inserted into the cap 31 will be described. As shown in FIG. 5A, the ink absorber 50 includes a first absorbing portion 51 to be inserted into the first space 41 and a second absorbing portion 52 formed continuously and integrally with the lower portion of the first absorbing portion 51 and inserted into the second space 42.

The first absorbing portion 51 has the length L1 and the width W1 or smaller dimensions so as to be inserted into the first space 41. The vertical dimensions are set so that the upper surface is positioned to a level a little lower than the opening end 35*a* in a state of being inserted into the first space 41, so that the entire part is formed into a parallelepiped shape.

In contrast, the second absorbing portion 52 has the length L1 of the second space 42 in the fore-and-aft direction in the fore-and-aft direction, or smaller dimensions, and has the same width as the first absorbing portion 51 in the left and right direction (the front and back direction of the paper plane) in the fore-and-aft direction so as to be inserted into the second space 42. Then, the second absorbing portion 52 is formed with an incised slit 53 at a position (the center portion here) which engages the rib 40 when inserted into the second space 42. Formed on the lower end side of the slit 53, that is, at an end of the slit 53 where incision is started are a cut surface 54 and a cut surface 55 cut obliquely on both sides in the fore-and-aft direction. These cut surfaces 54 and 55 form a triangular cut-shaped portion in the member of the absorber at the lower end side of the slit 53.

In this embodiment, the slit 53 is incised to have a height H3 upward from a lower end surface of the ink absorber 50 so as to allow completion of insertion without stopping the rib 40 having the height H2 in the course of insertion when inserting the ink absorber 50 into the cap 31. The height H3 originally has a dimension in the range which does not divide the first absorbing portion 51 (the first absorbing portion 51). Also, when inserting the ink absorber 50 into the cap 31, a width portion which corresponds to a bottom side of a triangular shape of the cut-shaped portion having a width Wk which is larger than the width Wr of the rib 40 is formed on the cut surface 54 or the cut surface 55 so as to come into abutment with the rib 40 to allow the rib 40 to be reliably inserted into the slit 53.

Figure 5B:
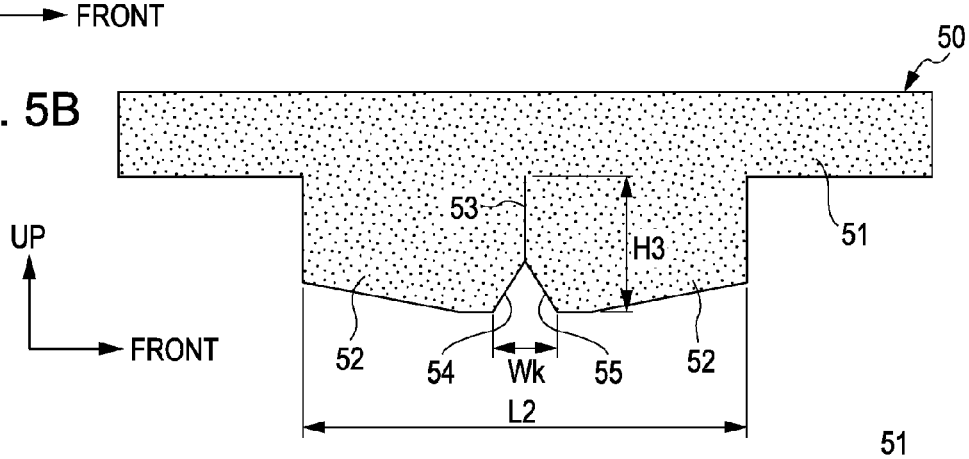
FIG. 5B is a side view of the same liquid absorber.
Figure 5C:
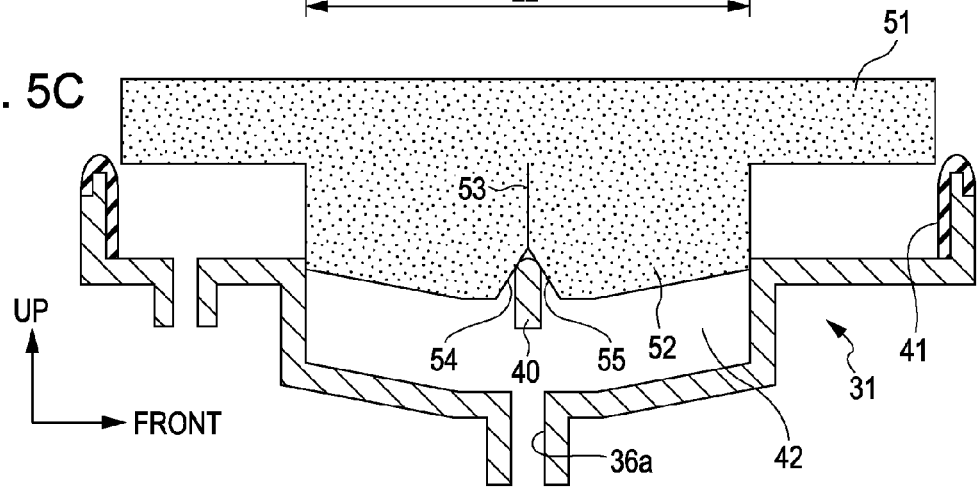
FIG. 5C is a cross-sectional end view showing a state in which the same liquid absorber is in the course of being inserted into the cap.

Referring now to FIGS. 5B and 5C, an action taken when the ink absorber 50 formed in this manner is inserted into the cap 31 will be described.

As shown in FIG. 5B, when inserting the ink absorber 50 into the cap 31 from above, the first absorbing portion 51 is in a state of not being inserted completely into the first space 41 at a time point when the insertion of the second absorbing portion 52 into the second space 42 is started. Therefore, the second absorbing portion 52 is subject to a positional displacement with respect to the second space 42 in the fore-and-aft direction. Even when the first absorbing portion 51 is in a state of being inserted into the first space 41, the second absorbing portion 52 is subject to the positional displacement with respect to the second space 42 in the fore-and-aft direction due to deformation of the first absorbing portion 51 or a gap between the first absorbing portion 51 and the cap 31.

Accordingly, when the ink absorber 50 is inserted into the cap 31 in a case where such a positional displacement is generated, either one of the cut surface 54 and the cut surface 55 formed at a lower end of the second absorbing portion 52 comes into abutment with the rib 40 as shown in FIG. 5B. Then, by a sliding movement of the rib 40 along the cut surfaces 54 and 55 in association with the insertion of the ink absorber 50, the ink absorber 50 brings the slit 53 into engagement with the rib 40 while moving in the fore-and-aft direction.

Subsequently, as shown in FIG. 5C, in a state in which the slit 53 engages adequately with the rib 40 and the ink absorber 50 is pushed into the cap 31 and is completely inserted, an urging force F1 in association with the compression in the fore-and-aft direction is generated at a portion of the ink absorber 50 where the rib 40 is inserted. The ink absorber 50 is stably held in the cap 31 by the urging force F1.

According to the embodiment described thus far, the following effects are achieved.

(1) Since the ink flowed into the cap 31 can be discharged to the waste liquid disposal port 36*a* via the communicating hole 46 from the both sides of the rib 40, the ink flowed into the second space 42 divided into two spaces by the single rib 40 in the cap 31 can be discharged through the single waste liquid disposal port 36*a*. Therefore, the configuration relating to a waste ink disposal is simplified.

(2) The waste liquid disposal port 36*a* can be formed easily by the molding process at a position overlapped two-dimensionally with the rib 40 on the side of the second bottom portion 42B of the rib 40.

(3) Since the inner wall surfaces 34*b* of the long side walls 34 in the longitudinal direction can be connected with the rib 40 by extending the rib 40 in the short direction, the inward inclination of the long side walls 34 at the time of the molding process can be inhibited.

(4) An ink receiving amount which flows into the cap 31 can be increased by providing the second bottom portion 42B which is deeper than the first bottom portion 41B, and the inward inclination of the long side walls 34 can be inhibited by extending the rib 40 at the farthest portions 42*b* which are farthest from the opening end 35*a*. Also, the ink flowed into the second bottom portion 42B can be guided reliably to the waste liquid disposal port 36*a* formed at a position where the rib 40 is extended, and be discharged therefrom.

(5) The position of the ink absorber 50 in the longitudinal direction (the fore-and-aft direction) in the cap 31 can be fixed by the rib 40 inserted into the slit 53. Therefore, since the ink absorber 50 can be inserted to an adequate position in the cap 31 by the slit 53, the probability that the ink is discharged to the waste liquid disposal port 36*a* is increased. Also, since the ink absorber 50 keeps abutment with the rib 40 even after the insertion while receiving the urging force F1 from the both sides thereof in the width direction by a portion of the slit 53, the position after the insertion is also stabilized.

(6) When the ink absorber 50 is inserted into the cap 31, even when there is a positional displacement between the slit 53 and the rib 40, the probability that the rib 40 is positioned within the width Wk of the triangular cut-shaped portion by the cut surfaces 54 and 55 is increased, so that the ink absorber 50 can be inserted adequately into the cap 31.

The respective embodiments described above may be modified to other embodiments as follows.

Figure 5D:
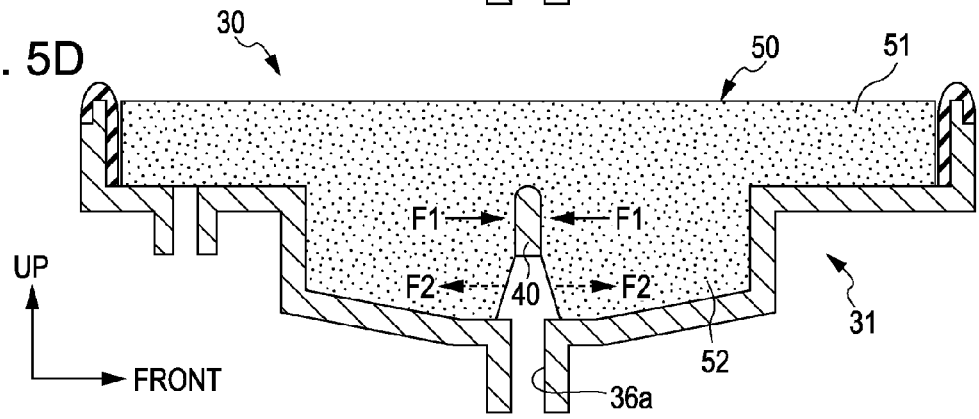
FIG. 5D is a cross-sectional end view showing a state in which the same liquid absorber is inserted into the cap.

In the respective embodiments described above, in a state in which the ink absorber 50 is inserted into the cap 31, since the slit 53 is widened in the fore-and-aft direction, an urging force F2 is generated in the direction opposite from the urging force F1, that is, in the direction to widen the triangular cut-shaped portion as shown in FIG. 5D. Therefore, there is a case where the second absorbing portion 52 may be displaced in the direction away from the waste liquid disposal port 36*a*. In such a case, the ink moved to the second absorbing portion 52 after having absorbed by the first absorbing portion 51 might not be introduced easily to the waste liquid disposal port 36*a*.

Then, in the cap 31, the vertical wall surfaces 42*c* formed between the second bottom portion 42B and the first bottom portion 41B (see FIG. 4A) may be formed into inclined surfaces respectively so as to be narrowed from each other toward the second bottom portion 42B. This modification will be described with reference to FIGS. 6A, 6B, and 6C.

Figure 6A:
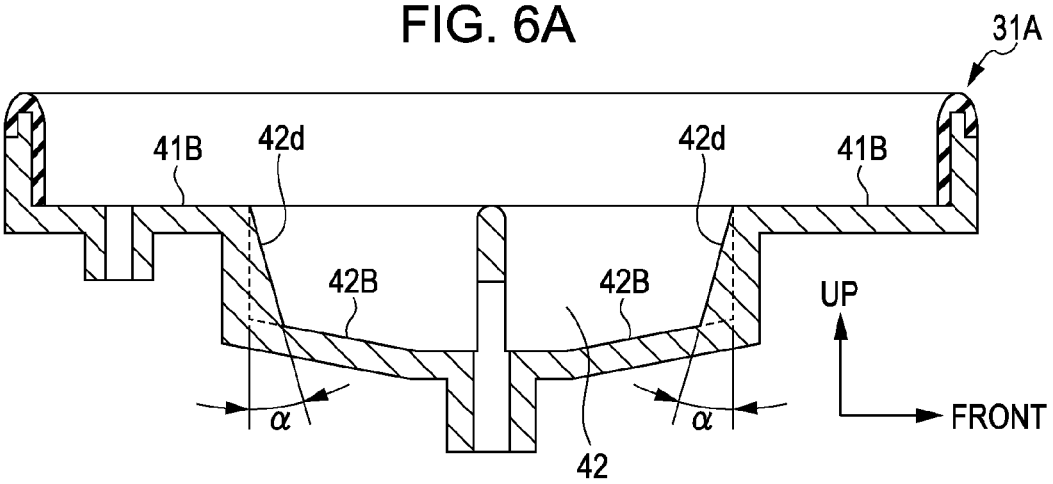
FIG. 6A is a cross-sectional view showing the shape of a cap according to a modification.

As shown in FIG. 6A, a cap 31A in this modification has the pair of front and rear wall surfaces 42*d* which define the second space 42 are formed of inclined surfaces inclined by an angle α with respect to the vertical direction so as to be inclined downward from the first bottom portion 41B toward the second bottom portion 42B and be narrowed in distance with respect to each other as it goes to the lower end side.

Figure 6B:
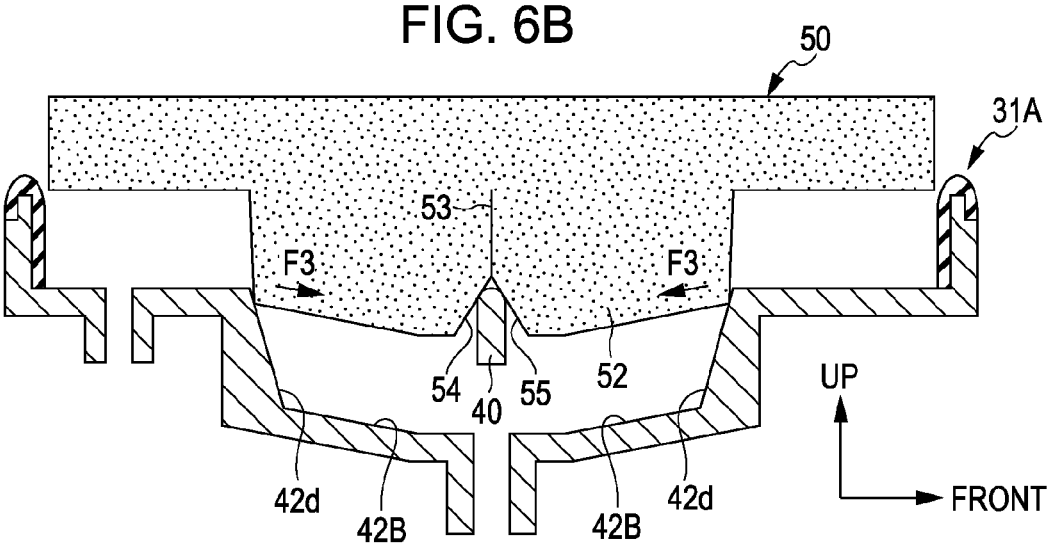
FIG. 6B is a cross-sectional end view showing a state in which the liquid absorber according to the embodiment is in the course of being inserted into the cap according to the modification.

An action generated in the ink absorber 50 when the ink absorber 50 is inserted into the cap 31A formed in this manner will be described. In other words, when the ink absorber 50 is inserted into the cap 31A from above as shown in FIG. 6B, insertion of the second absorbing portion 52 toward the second bottom portion 42B into the second space 42 is started. At this time, the slit 53 is aligned with the rib 40 in the fore-and-aft direction by the cut-shaped portion defined by the cut surface 54 and the cut surface 55 formed at the lower end of the second absorbing portion 52 as described above. At the same time, both end portions of the second absorbing portion 52 in the fore-and-aft direction come into abutment with the respective inclined wall surfaces 42*d*. With this abutment, the second absorbing portion 52 is subject to an urging force F3 in the direction in which the slit 53 is formed.

Figure 6C:
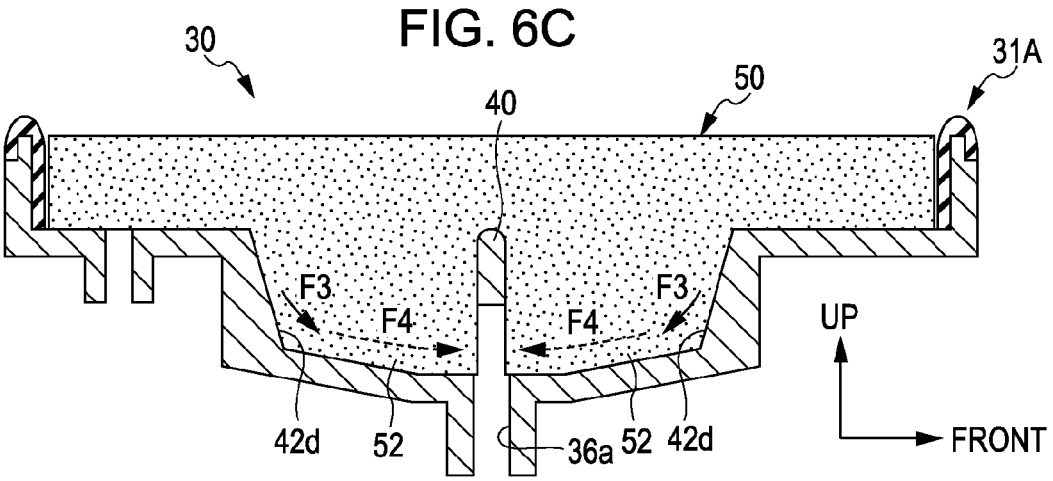
FIG. 6C is an end view showing a state in which the same liquid absorber is inserted into the same cap.

Subsequently, in a state in which the rib 40 is inserted into the slit 53 and insertion of the ink absorber 50 into the cap 31A is completed as shown in FIG. 6C, an urging force F4 which tries to bring the cut surfaces 54 and 55 of the ink absorber 50 toward the waste liquid disposal port 36*a* is generated. In other words, when the second absorbing portion 52 is pushed toward the slit 53 (toward the waste liquid disposal port 36*a*) by the urging force F3 generated by the wall surfaces 42*d* in the state in which the rib 40 is inserted, the urging force F4 is generated by the cut surfaces 54 and 55.

In this modification, in addition to the effects (1) to (6) according to the embodiments described above, the following effects can be obtained.

(7) When the second absorbing portion 52 of the ink absorber 50 is inserted toward the second bottom portion 42B of the cap 31A, the ink absorber 50 is guided toward the center of the second bottom portion 42B, that is, toward the waste liquid disposal port 36*a*, by the respective wall surfaces 42*d* formed in the fore-and-aft direction of the second bottom portion 42B. Therefore, since the ink absorber 50 can be guided toward the waste liquid disposal port 36*a* formed at the position where the rib 40 is extended, the probability that the ink can be discharged is increased.

In the embodiments described above, the slit 53 of the ink absorber 50 may be provided a gap to have a width thereof not larger than the width Wr of the rib 40. This modification will be described with reference to FIGS. 7A and 7B.

Figure 7A:
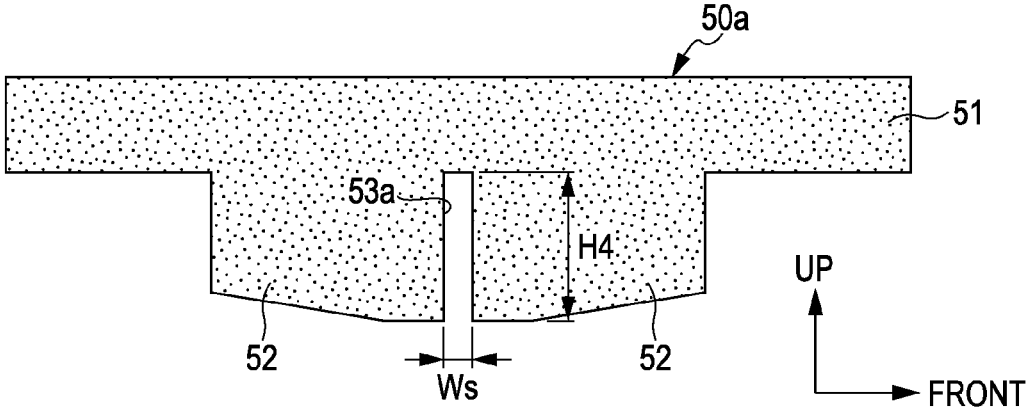
FIG. 7A is a side view showing the shape of a liquid absorber according to a first modification.

As shown in FIG. 7A, an ink absorber 50*a* in this modification is formed with a slit 53*a* having a width Ws in the fore-and-aft direction and a height H4 from the lower surface in the second absorbing portion 52. The width Ws of the slit 53*a* is formed to have the largest possible dimension within a range not exceeding the width Wr of the rib 40 so as to allow easy engagement of the slit 53*a* with the rib 40 when the second absorbing portion 52 is inserted into the second space 42. Also, the height H4 of the slit 53*a* is formed to have a height which allows completion of insertion of the rib 40 having the height H2 without stopping in the course of insertion when the ink absorber 50*a* is inserted into the cap 31 (31A). For reference sake, in this modification, the width Ws of the slit 53*a* is the same as the width Wr of the rib 40, and the height H4 is the same as the height H3 of the slit 53 in the embodiments described above.

The ink absorber 50*a* formed with the slit 53*a* having the width Ws (Wr) as described above is configured in such a manner that the second absorbing portion 52 approaches the waste liquid disposal port 36*a* and the inserted state is stably maintained when being inserted into the cap 31A of the modification described above. This action will be described with reference to FIG. 7B.

Figure 7B:
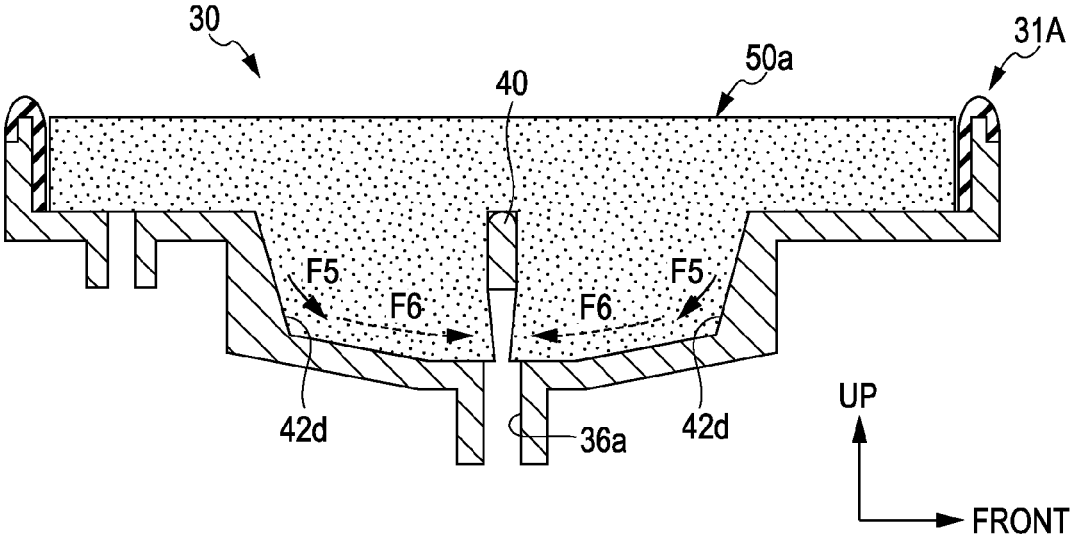
FIG. 7B is a cross-sectional end view showing a state in which the liquid absorber in the first modification is inserted into the cap according to the modification.

In a state in which the rib 40 is inserted into the slit 53*a* and the insertion of the ink absorber 50*a* into the cap 31A is completed as shown in FIG. 7B, an urging force F6 which tries to narrow the gap of the slit 53*a* of the ink absorber 50 and bring the second absorbing portion 52 toward the waste liquid disposal port 36*a* is generated.

In other words, the urging force F6 is generated by the second absorbing portion 52 pushed toward the slit 53*a* by an urging force F5 generated by the wall surfaces 42*d* in the state in which the rib 40 is inserted. Consequently, by the action of the urging force F6 with respect to the inserted rib 40 from the both sides in the fore-and-aft direction, the distance of the slit 53*a* is reduced at a portion of the second absorbing portion 52 opposing the communicating hole 46 formed on the downside of the rib 40.

In this modification, in addition to the effects (1) to (6) according to the embodiments described above and the effect (7) of the modification described above, the following effects can be obtained.

(8) When the ink absorber 50*a* is inserted into the cap 31, even when there is a positional displacement between the slit 53*a* and the rib 40, the probability that the rib 40 is positioned within the width of the slit 53*a* is increased, so that the ink absorber 50*a* can be inserted adequately into the cap 31. Also, when inserting the ink absorber 50*a* into the cap 31A, the ink absorber 50*a* after having inserted is urged at a portion of the slit 53*a* by the both sides of the rib 40 in the width direction and is abutted thereto and the distance is reduced on the downside of the rib 40, whereby the state of insertion is stably maintained.

In the modification described above, when the width Ws of the slit 53*a* is smaller than the width Wr of the rib 40 for example, a case where the rib 40 is not adequately inserted into the slit 53*a* tends to occur. Therefore, as another modification of the modification described above, it is also possible to employ a liquid absorber provided with a rectangular cut-shaped portion having a width in the fore-and-aft direction to be at least the width Wr of the rib 40 at an upper end portion of the slit 53*a* as the ink absorber 50*a*. This modification will be described with reference to FIGS. 8A, 8B, and 8C.

Figure 8A:
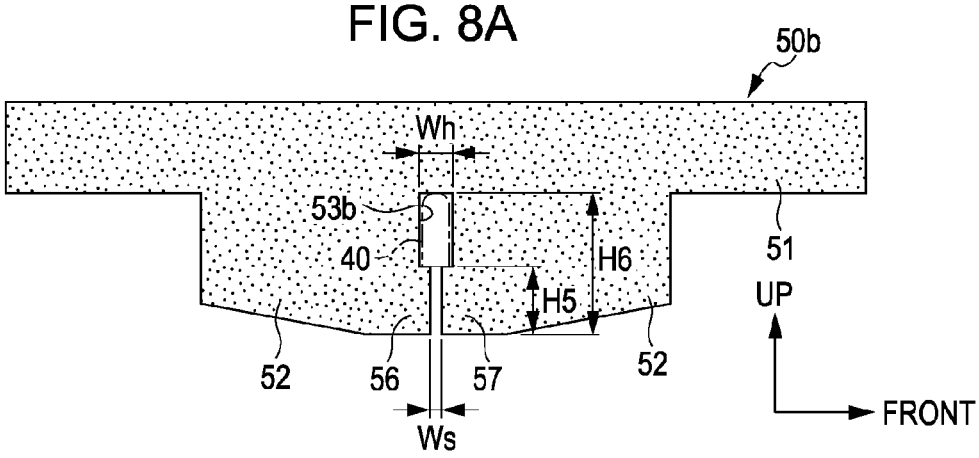
FIG. 8A is a side view showing the shape of a liquid absorber according to a second modification.

As shown in FIG. 8A, an ink absorber 50*b* in this modification is formed with a slit 53*b* being wider in the back side including a slit portion having the width Ws in the fore-and-aft direction and a height H5 from a lower surface and a slit portion having a width wh in the fore-and-aft direction and a height H6 from the lower surface in the second absorbing portion 52. In other words, the second absorbing portion 52 is formed with L-form shaped portions 56 and 57 with a gap having the width Ws and the height H5 on the lower end side, and a rectangular cut-shaped portion with a gap having the width Wh and a height corresponding to the difference between the height H6 and the height H5 is formed on the upper side.

The width Wh of the slit 53*b* which becomes the rectangular cut-shaped portion is formed to have at least the width Wr of the rib 40 so as to avoid engagement of the rib 40 with the slit 53*b* in the vertical direction when the second absorbing portion 52 is inserted into the second space 42 in this modification. Also, the height H6 of an upper end of the slit 53*b* is formed to be a height which allows insertion of the rib 40 having the height H2 without coming into abutment in the vertical direction when the ink absorber 50*b* is inserted into the cap 31 (31A).

In this embodiment, the height H5 of the shaped portions 56 and 57 is formed to have a dimension not exceeding the height H1 (see FIG. 4A) of the communicating hole 46 formed on the rib 40. The width Wh of the slit 53*b* is set to a dimension larger than the width Wr of the rib 40 by a dimension corresponding to variations in dimension when forming the rib 40 and the slit 53*b*. Originally, the larger the width Wh and the smaller the height H5 of the shaped portions 56 and 57, the easier the rib can be inserted. However, since the capacity of the ink absorber 50 is reduced, the width Wh is preferably as small as possible, and the height H5 is preferably as large as possible.

The ink absorber 50*b* formed with the slit 53*b* in this manner is configured in such a manner that the second absorbing portion 52 can be inserted into the second space 42 adequately even when the positional displacement is generated between the slit 53*b* and the rib 40 when inserting the ink absorber 50*b* into the cap 31 in the embodiments described above. This action will be described with reference to FIG. 8B and FIG. 8C.

Figure 8B:
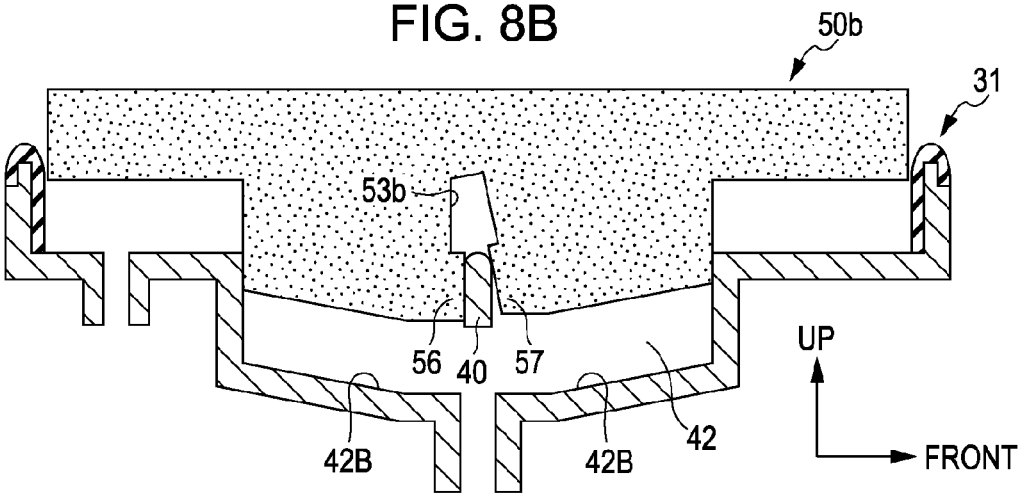
FIG. 8B is a cross-sectional end view showing a state in which the liquid absorber according to the second modification is in the course of being inserted into the cap according to the embodiment.

In this modification, it is assumed that the ink absorber 50*b* is inserted into the cap 31 in a state of being shifted rearward. Then, as shown in FIG. 8B, the shaped portion 57 formed on the front side on the lower end side of the second absorbing portion 52 comes into abutment with the rib 40 in the vertical direction. Therefore, the shaped portion 57 moves the ink absorber 50*b* so as to allow the rib 40 to be adequately inserted into the slit 53*b* in cooperation with the shaped portion 56 while being collapsed and deformed upward by the rib 40.

Figure 8C:
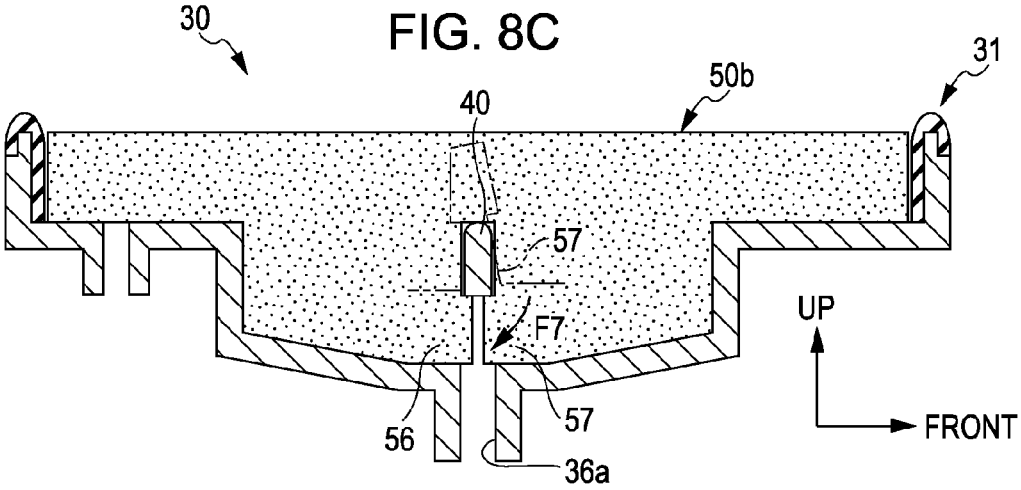
FIG. 8C is a cross-sectional end view showing a state in which the liquid absorber according to the second modification is inserted into the cap according to the embodiment.

Subsequently, as shown in FIG. 8C, in a state in which the ink absorber 50*b* is pushed into the cap 31 and is completely inserted, the rib 40 is positioned in a rectangular cut-shaped portion of the ink absorber 50*b*. In this state, the upper side of the rib 40 is positioned in the rectangular cut-shaped portion, and hence the deformation of the shaped portion 57 is released on the upper portion of the rib 40. Therefore, at least a portion of the shaped portion 57 opposing to the portion where the communicating hole 46 is formed is returned back to the shape before deformation as indicated by an arrow F7. At this time, the portion of the shaped portion 57 (56) opposing the communicating hole 46 which communicates with the waste liquid disposal port 36*a* in the left and right direction (the front and back direction of the paper plane) enters into the communicating hole 46.

In this modification, in addition to the effects (1) to (5) according to the embodiments described above, the following effects can be obtained.

(9) Since the probability that the deformation of the ink absorber 50*b* is released is increased by the ink absorber 50*b* pushed into the cap 31 and the rib 40 positioned in the width Wh of the rectangular cut-shaped portion formed on the upper end side of the slit 53*b*, the ink absorber 50*b* can be inserted adequately into the cap 31. Also, since the ink absorber 50*b* can hardly come off in the upward direction by the shaped portions 56 and 57 entering into the communicating hole 46, the position after insertion is also stabilized.

In the ink absorber 50*b* in the modification described above, it is also possible not to form the gap between the shaped portion 56 and the shaped portion 57. This modification will be described with reference to FIGS. 9A, 9B, 9C, and 9D.

Figure 9A:
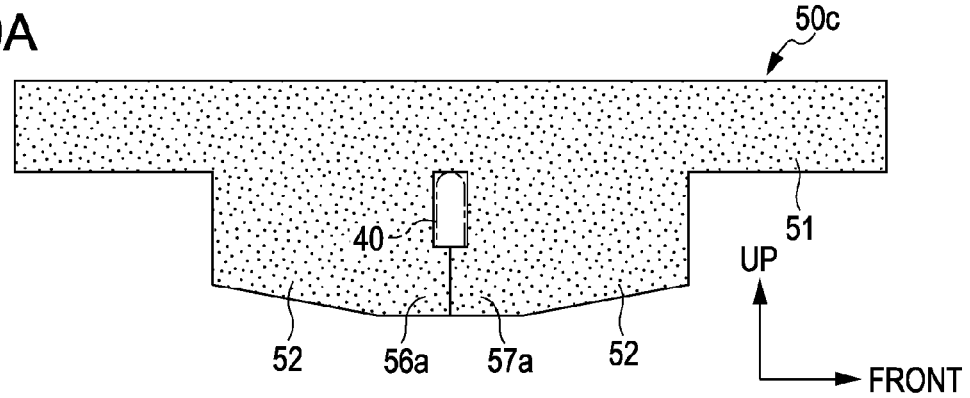
FIG. 9A is a side view showing the shape of a liquid absorber according to a third modification.

As shown in FIG. 9A, an ink absorber 50*c* in this modification may have a shape having shaped portions 56*a* and 57*a* extending so as to bring the shaped portions 56 and 57 into abutment with the ink absorber 50*b* in the modification described above in the fore-and-aft direction.

Figure 9B:
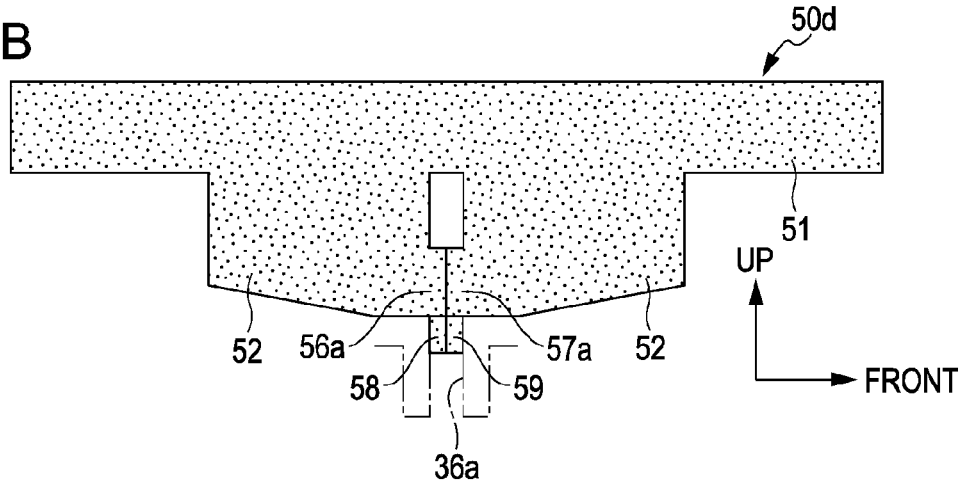
FIG. 9B is a side view showing the shape of a liquid absorber according to a fourth modification.

In addition, in order to guide and discharge the ink reliably into the waste liquid disposal port 36*a*, the ink absorber 50*d* having projecting-shaped portions 58 and 59 which enter into the waste liquid disposal port 36*a* by a predetermined amount on the downside of a portion where the shaped portion 56 and 57 come into abutment with as shown in FIG. 9B.

Figure 9C:
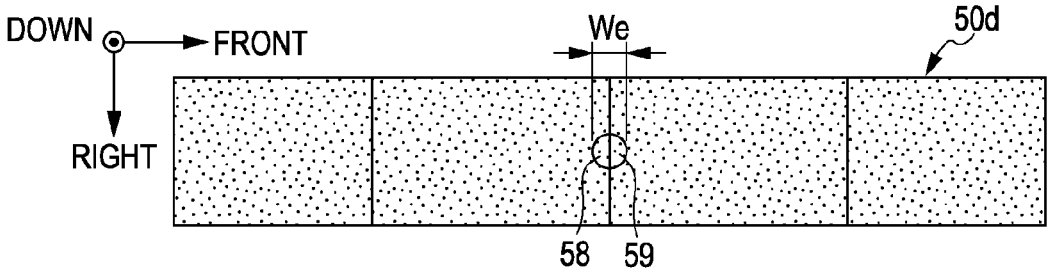
FIG. 9C is a bottom view of the liquid absorber according to the fourth embodiment viewed from below.

Then, the projecting-shaped portions 58 and 59 formed at this time may each be formed into a semi-column shape to allow insertion into the waste liquid disposal port 36*a* as shown in FIG. 9C. In a state in which the projecting-shaped portions 58 and 59 formed into the semi-column shape are in abutment, the projecting-shaped portions 58 and 59 are preferably formed so that the maximum diameter does not exceed the width We (preferably, smaller than the width We).

Figure 9D:
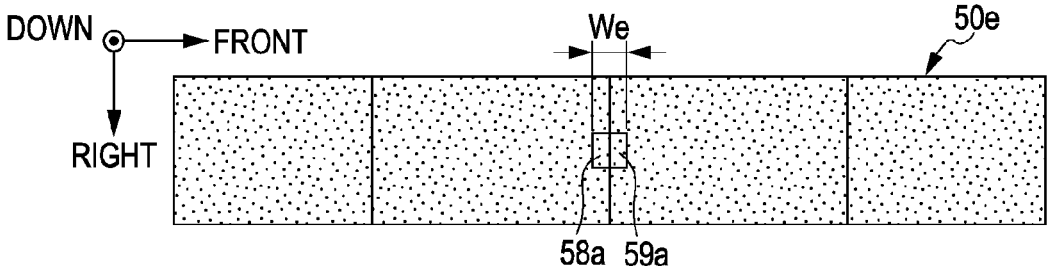
FIG. 9D is a bottom view of a liquid absorber according to a fifth embodiment viewed from below.

Alternatively, an ink absorber 50*e* formed of projecting-shaped portions 58*a* and 59*a* each having a quadratic prism shape may be employed so that the projecting-shaped portions 58 and 59 formed at this time may be inserted into the waste liquid disposal port 36*a* as shown in FIG. 9D. In a state in which the projecting-shaped portions 58*a* and 59*a* formed into the quadratic prism shape are in abutment, the dimension of one side of a square formed on a lower surface is preferably formed into a quadratic prism having a width not exceeding the width We (preferably, smaller than the width We).

In this modification, in addition to the effects (1) to (5) according to the embodiments described above, the following effects can be obtained.

(10) In a state in which the ink absorber 50*c* is pushed into the cap 31 and insertion is completed, a portion of the shaped portions 56*a* and 57*a* entering into the communicating hole 46 is increased, so that the ink can be guided reliably to the waste liquid disposal port 36*a*. In addition, in a state in which the ink absorbers 50*d* and 50*e* are pushed into the cap 31 and insertion is completed, there exists a portion of the projecting-shaped portions 58 and 59 (58*a* and 59*a*) entering into the waste liquid disposal port 36*a*, so that the ink can be guided reliably to the waste liquid disposal port 36*a*.

In the ink absorbers 50*b* and 50*c* in the modification described above, the shaped portions 56 and 57 (the shaped portions 56*a* and 57*a*) are formed to have a thickness in the left and right direction (the front and back direction of the paper plane) not exceeding the width Wf (or the width Wr) in the left and right direction of the communicating hole 46. Accordingly, when the ink absorbers 50*b* and 50*c* are inserted into the cap 31 (the cap 31A), the shaped portions 56 and 57 (the shaped portions 56*a* and 57*a*) can be caused to enter reliably into the communicating hole 46.

In the embodiments described above, the cap 31 may be provided with a check valve 70 at the air intake port 37*a* provided in the first space 41 so as to prevent the ink from flowing from the first space 41 to the air intake port 37*a*. This modification will be described with reference to FIGS. 10 to 12. In the embodiment shown below, a case where the ink absorber 50 is not provided will be described. However, the ink absorber 50 may be provided.

Figure 10:
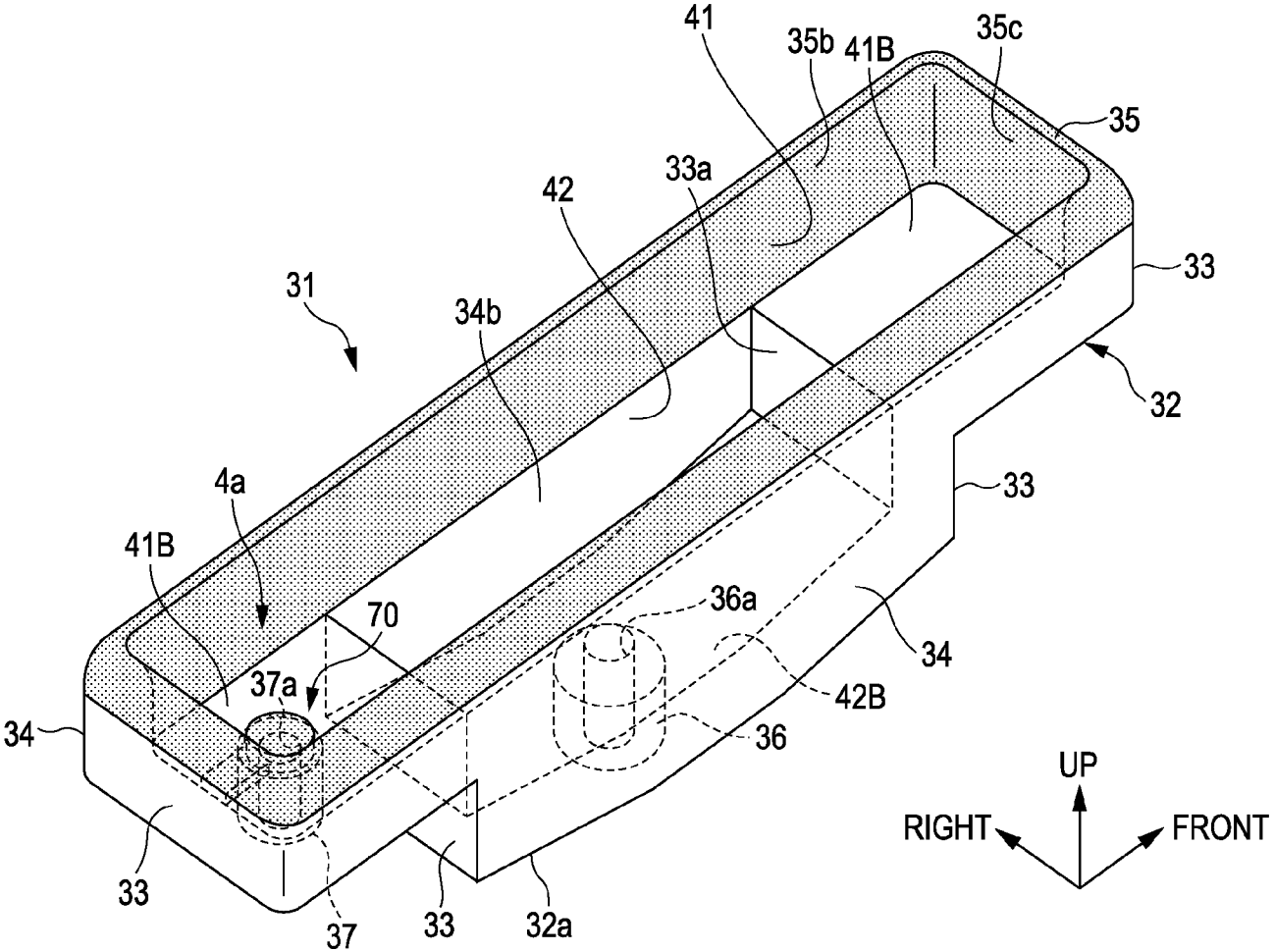
FIG. 10 is a perspective view showing the cap provided with a check valve according to the embodiment.

As shown in FIG. 10, the cap 31 according to this embodiment has a shape in which two large and small substantially parallelepiped shapes having different lengths in the longitudinal direction (fore-and-aft direction) are placed one on top of another in the vertical direction. More specifically, in the cap body 32, the pair of front and rear short side walls 33 are formed so that the inner side of the cap 31 of each of the short side walls 33 is formed into a stair-like shape having two vertical wall surfaces apart from each other in the fore-and-aft direction and a horizontal floor surface connecting a lower end of one of the two vertical wall surfaces and an upper end of the other vertical wall surface. Also, the pair of left and right long side walls 34 are each formed to have the inner surface of the cap 31 having a substantially T-shaped vertical wall surface when viewed in the left and right direction. Then, the bottom wall 32*a* formed with the discharge liquid portion 36 so as to project therefrom is formed into a rectangular shape in plan view.

In addition, in this embodiment, the square ring-shaped cap seal portion 35 (hatched portion in the drawing) is provided at the upper end portion of the cap body 32 as described above. Then, the cap seal portion 35 includes long pending wall portions 35*b* pending inward of the cap body 32 while extending along the longitudinal direction of the cap body 32, and the short pending wall portions 35*c* pending inward of the cap body 32 while extending along the short direction of the cap body 32, and the long pending wall portions 35*b* are formed so as to come into tight contact with the inner surface of the long side walls 34, and the short pending wall portions 35*c* are formed so as to come into tight contact with the inner surface of the short side walls 33, respectively. In this embodiment, the cap seal portion 35 is formed as a secondary side after the cap body 32 has molded as a primary side, that is so-called a two-color molding.

Consequently, the cap 31 is formed with a substantially rectangular-shaped opening having the longitudinal direction in the fore-and-aft direction by the cap seal portion 35. Also, the first space 41 is formed on the side of the opening in the interior of the cap 31 by the pair of left and right long pending wall portions 35*b* and the pair of front and rear short pending wall portions 35*c* of the cap seal portion 35, and horizontal floor surfaces of the pair of front and rear long side walls 34. Therefore, since the horizontal floor surfaces of the long side walls 34 correspond to the bottom portion of the first space 41, it is referred to as the first bottom portion 41B (see FIG. 10).

Furthermore, formed on the downside of the first space 41 is the second space 42 defined by inner surfaces of lower vertical wall surfaces 33*a* on the down side of the short side walls 33, the inner wall surfaces 34*b* of the long side walls 34, and the bottom wall 32*a*, which is narrower than the first space 41 evenly in the fore-and-aft direction. Therefore, since the inner surface of the bottom wall 32*a* of the cap body 32 corresponds to the bottom portion of the second space, this is referred to as the second bottom portion 42B (see FIG. 10). The second bottom portion 42B is formed with the waste liquid disposal port 36*a* for discharging waste liquid from the second space 42 at the substantially center thereof.

The cap 31 in this embodiment includes the check valve 70 in a plane area of the first bottom portion 41B which constitutes a closed space so as to cover the air intake port 37*a* formed in the first bottom portion 41B positioned upward, which corresponds to the direction opposite from the direction of the gravitational force, of the second bottom portion 42B from the side of the first space 41, which is inside the cap 31. Therefore, the check valve 70 in this embodiment is positioned in the direction opposite from the direction of the gravitational force with respect to the waste liquid disposal port 36*a* provided on the second bottom portion 42B. The configuration of the check valve 70 will be described with reference to FIGS. 11A to 11C.

Figure 11A:
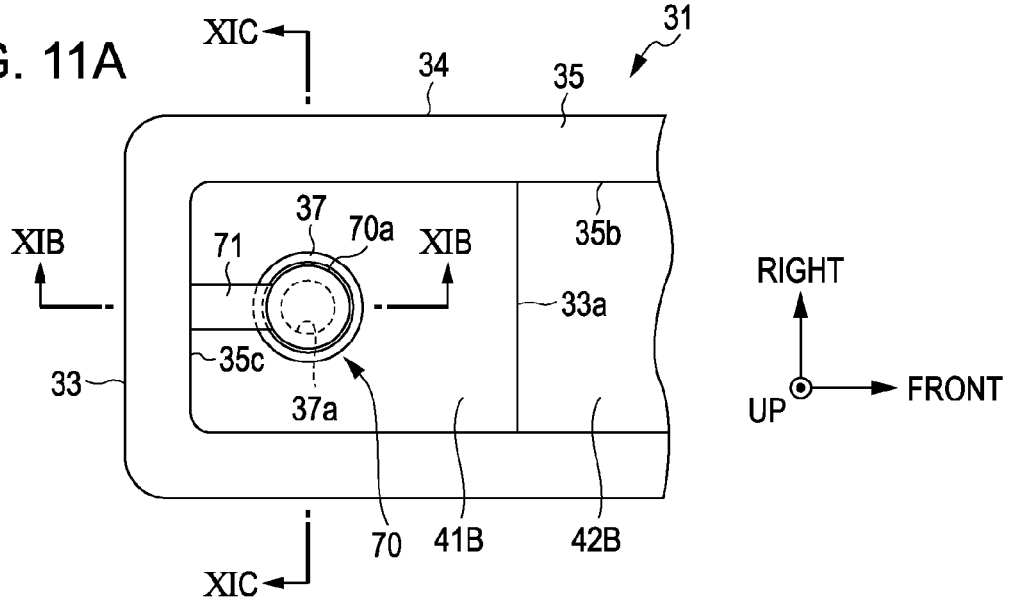
FIG. 11A is a plan view showing a configuration of the check valve according to the embodiment.
Figure 11B:
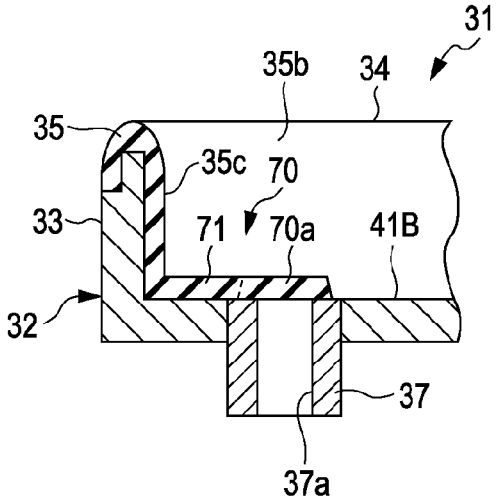
FIG. 11B is a cross-sectional view taken along the line XIB-XIB in FIG. 11A.
Figure 11C:
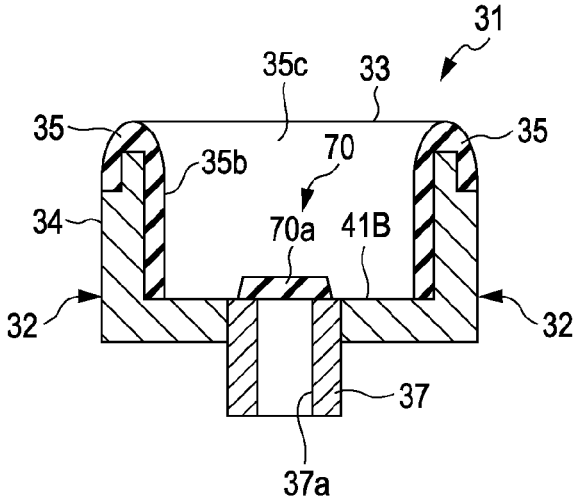
FIG. 11C is a cross-sectional view taken along the line XIC-XIC in FIG. 11A.

As shown in FIGS. 11A, 11B, and 11C, the check valve 70 includes a substantially circular valve portion 70*a* having a predetermined thickness in the vertical direction, and a coupling portion 71 formed into a band shape which connects the valve portion 70*a* and a lower end of the short pending wall portions 35*c* of the cap seal portion 35. The valve portion 70*a* is formed on an upper surface, which is a closed space side, of the first bottom portion 41B. Then, the check valve 70 comes into abutment with the air intake portion 37 from above, that is, from the first space 41 side, and is configured to cover and close the air intake port 37*a* without any gap therebetween.

Here, in this embodiment, the air intake portion 37 having the air intake port 37*a* so as to penetrate therethrough is formed of a cylindrical member having a circular outline in top view in a state of being inserted into the cap body 32. The check valve 70 in this embodiment can be molded by the molding process simultaneously with the cap seal portion 35 (the short pending wall portions 35*c*) by the coupling portion 71, and can form a check valve structure by the cap 31 by the air intake portion 37 formed by the insertion of the cylindrical member. A method of forming the check valve 70 formed on the cap 31 by the molding process and the insertion of the air intake portion 37 will be described with reference to FIGS. 12A to 12C.

Figure 12A:
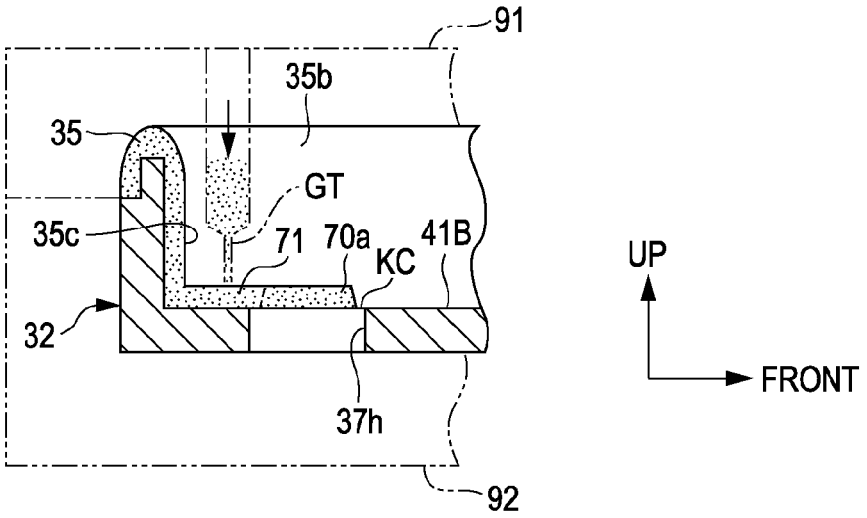
FIG. 12A is a partial cross-sectional view showing a state of molding of the check valve according to the embodiment.
Figure 12B:
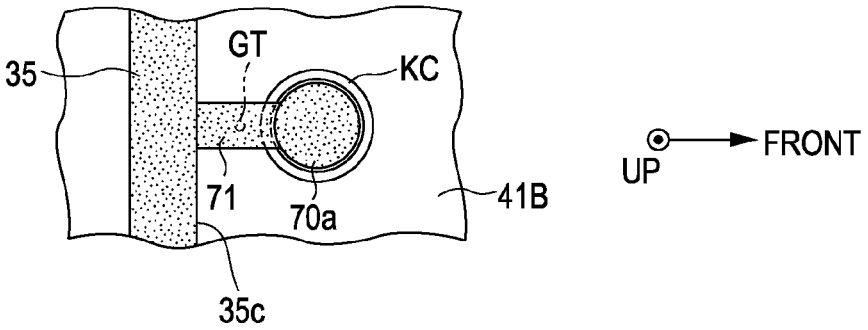
FIG. 12B is a partial plan view showing the state of molding of the check valve.

As shown in FIGS. 12A and 12B, the check valve 70 is molded simultaneously with the cap seal portion 35 as the secondary side by an upper mold 91 on the upper side and a lower mold 92 on the lower side with respect to the cap body 32 which has already molded as the primary side. At this time, in order to form the check valve 70 to be molded as a movable portion which is not fixed to the cap body 32, an abutment area KC, which is an area where the upper mold 91 and the lower mold 92 come into abutment with each other in the vertical direction so as to be molded in a state of being apart from the cap body 32. Therefore, the abutment area KC is an area where the material is not filled after the molding process.

In this state, when the upper mold 91 and the lower mold 92 are moved apart from each other after a material for forming the cap seal portion 35 and the check valve 70 has been injected from a gate GT provided on the upper mold 91 in the area of the coupling portion 71, the coupling portion 71 and the check valve 70 are formed simultaneously with the formation of the cap seal portion 35. The formed check valve 70 is apart from the cap body 32, while the coupling portion 71 continuing to the check valve 70 becomes a fixed portion secured to the cap body 32.

Figure 12C:
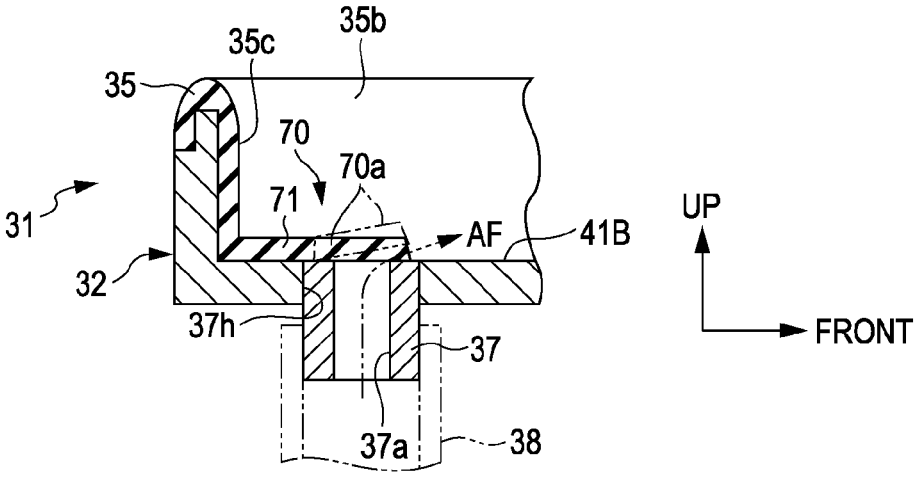
FIG. 12C is a partial cross-sectional view showing a structure of formed check valve.

In this manner, in a state in which molding of the cap seal portion 35 and the check valve 70 is completed, a fixing hole 37*h* having a size which allows insertion and fixation of the air intake portion 37 is formed in an area of the cap body 32 where the air intake portion 37 is provided by the lower mold 92. Therefore, the air intake portion 37, being the cylindrical member, is inserted into the fixing hole 37*h* from below and fixes the same as shown in FIG. 12C. Consequently, the air intake port 37*a* being a through hole provided on the air intake portion 37 is overlapped with the check valve 70 in the vertical direction, and is closed by the check valve 70. At this time, simultaneously, the abutment area KC which is used to be a gap is closed by the air intake portion 37. Therefore, at the portion where the air intake port 37*a* is formed, the check valve 70 which occupies only predetermined thickness and surface area is formed on the side of the first space 41.

Subsequently, the action of the check valve 70 formed in this manner will be described with reference to FIG. 12C. As shown in FIG. 12C, the check valve 70 is configured in structure to be displaced so that the valve portion 70*a*, which is the movable portion, is lifted upward, which is the closed space side, from a distal end portion on the side opposite from the coupling portion 71, about the coupling portion 71 side, which is the fixed portion fixed to the cap body 32, as a supporting point. In other words, the valve portion 70*a*, which is the movable portion, is displaced between a covered position where the valve portion 70*a* covers and closes the air intake port 37*a* from the inside of the closed space (a position of a solid line shown in FIG. 12C) to an open position where the valve portion 70*a* moves away from the covered position and opens the air intake port 37*a* (a position indicated by a double-dashed chain line in FIG. 12C). Therefore, when the atmospheric relief valve 39 is opened after the interior of the closed space has been vacuumed by the suction pump 26, as indicated by an arrow AF in the drawing, the valve portion 70*a* is displaced from the closed position to the open position and hence the air intake port 37*a* is opened, which allows movement of air from the outside into the closed space via the air intake port 37*a*. In other words, the outside air (air) is allowed to flow into the first space 41 from the lower side of the air intake port 37*a*. In contrast, the ink in the first space 41 presses the valve portion 70*a* in the direction opposite from the direction to lift the valve portion 70*a* when trying to flow out from the air intake port 37*a*, so that the ink in the first space 41 is inhibited from flowing out of the area of the first space 41, that is, out of the area of the closed space, via the air intake port 37*a*.

In this modification, in addition to the effects (1) to (10) according to the embodiments described above, the following effects can be obtained.

(11) Since the ink in the cap 31 can be prevented from flowing out of the area of the first space 41 via the air intake port 37*a*, for example, inflow of liquid into the air intake tube 38 connected to the air intake port 37*a* for a relief to the atmospheric air can be inhibited. In addition, since the air can be flowed into the first space 41 after the closed space has been vacuumed, the closed space can be relieved to the atmospheric air.

(12) The check valve 70 having a simple structure which includes the valve portion 70*a* and the coupling portion 71 and occupies small volume is obtained in an area of the cap 31 where the air intake port 37*a* is formed. Therefore, inflow of ink into the air intake tube 38 for the relief to the atmospheric air can be reliably inhibited while inhibiting a reduction of the area of the first space 41 which receives the ink.

(13) For example, when the cap seal portion 35 is formed by the molding process, the cap seal portion 35 can be molded simultaneously with the check valve 70.

(14) For example, when the cap seal portion 35 and the check valve 70 are formed simultaneously by the molding process, the gate GT for ejection can be used commonly.

(15) Since the ink in the cap 31 flows toward the waste liquid disposal port 36*a* positioned on the side of the direction of gravitational force with respect to the check valve 70, the probability that the ink stays in the periphery of the check valve 70 is lowered. Therefore, inflow of the ink into the air intake tube 38 connected to the air intake port 37*a* for the relief to the atmospheric air can be reliably inhibited.

In the embodiment described above, the check valve 70 may be formed separately from the cap seal portion 35 instead of being molded simultaneously with the cap seal portion 35 by the molding process. In this configuration, the check valve 70 and the cap seal portion 35 can be formed of materials which are suitable for the individual members. This modification will be described with reference to FIGS. 13A and 13B.

Figure 13A:
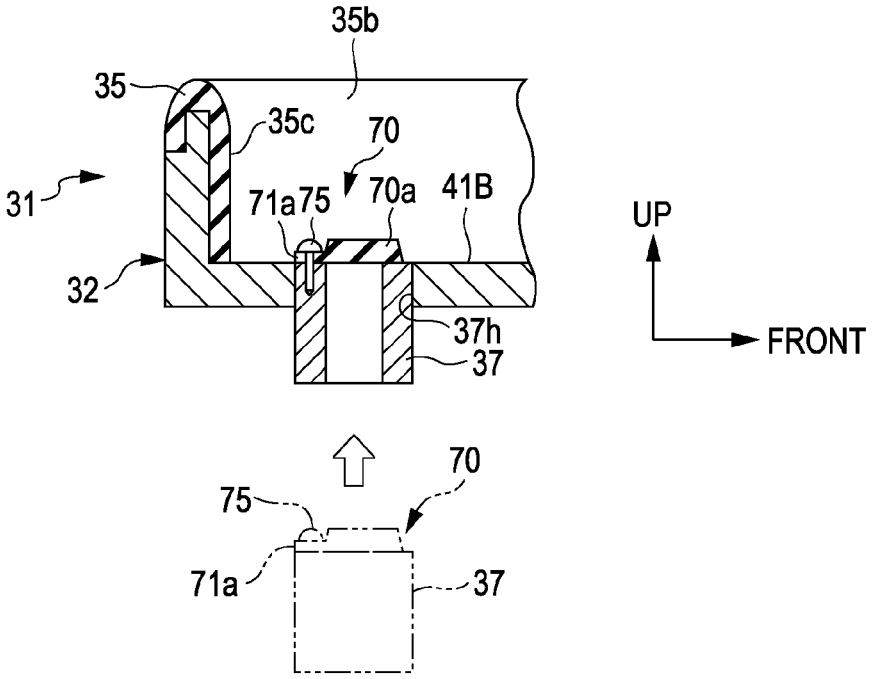
FIG. 13A is a cross-sectional view showing a configuration of the check valve according to a modification.

As shown in FIG. 13A, it is also possible to fix the check valve 70 to an upper surface side of the air intake portion 37 in advance, and then fix the air intake portion 37 to the cap body 32. More specifically, in the thick portion of the cylindrical portion of the air intake portion 37, a portion to be fixed 71*a* formed in a part of the valve portion 70*a* is fixed with a fixing device 75 such as a pin or a screw so as to be the portion to be fixed. Then, the air intake portion 37 formed with the check valve 70 by the fixation of the valve portion 70*a* with the fixed portion 71*a* is inserted into the fixing hole 37*h* from below and fixed to the cap body 32.

Figure 13B:
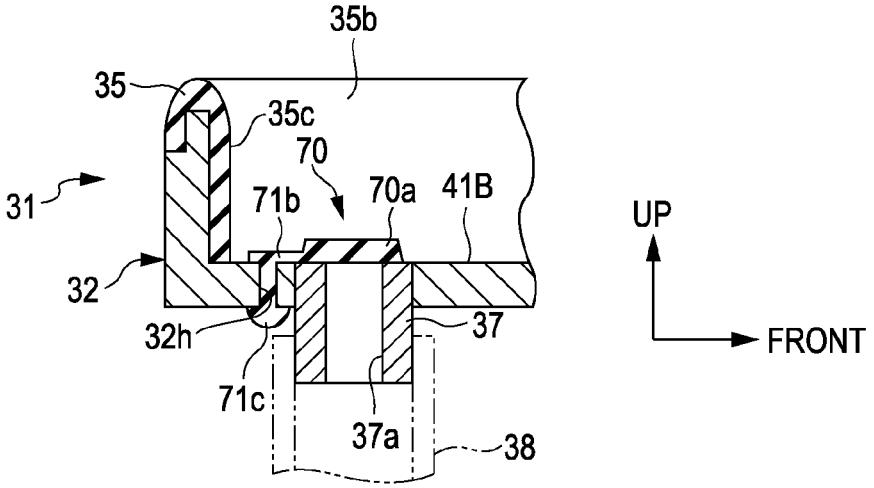
FIG. 13B is a cross-sectional view showing a configuration of the check valve according to another modification.

Alternatively, as shown in FIG. 13B, it is also possible to fix an extending portion 71*b* partly extending rearward from the valve portion 70*a* to the first bottom portion 41B of the cap body 32 so as to be the fixed portion after the air intake portion 37 has been fixed to the cap body 32. More specifically, a projecting portion 71*c* formed so as to project in the vertical direction, which is a substantially perpendicular to the surface covering the air intake port 37*a*, is fixed by being inserted into the fixing hole 37*h* formed in the cap body 32 so as to penetrate therethrough in the vertical direction. In this modification, the air intake portion 37 may be formed integrally with the cap body 32.

In the modification described above, the length of the second space 42 in the fore-and-aft direction may be the same as the length of the first space 41. In other words, the cap 31 may have a bottomed box-shaped cap body 32A having the first bottom portion 41B and the second bottom portion 42B formed into one continuous floor surface without any level difference. In this configuration, although the probability that the ink stays in the periphery of the check valve 70 is increased, the ink absorbing amount of the ink absorber more than the case of the embodiment is achieved. This modification will be described with reference to FIG. 14.

Figure 14:
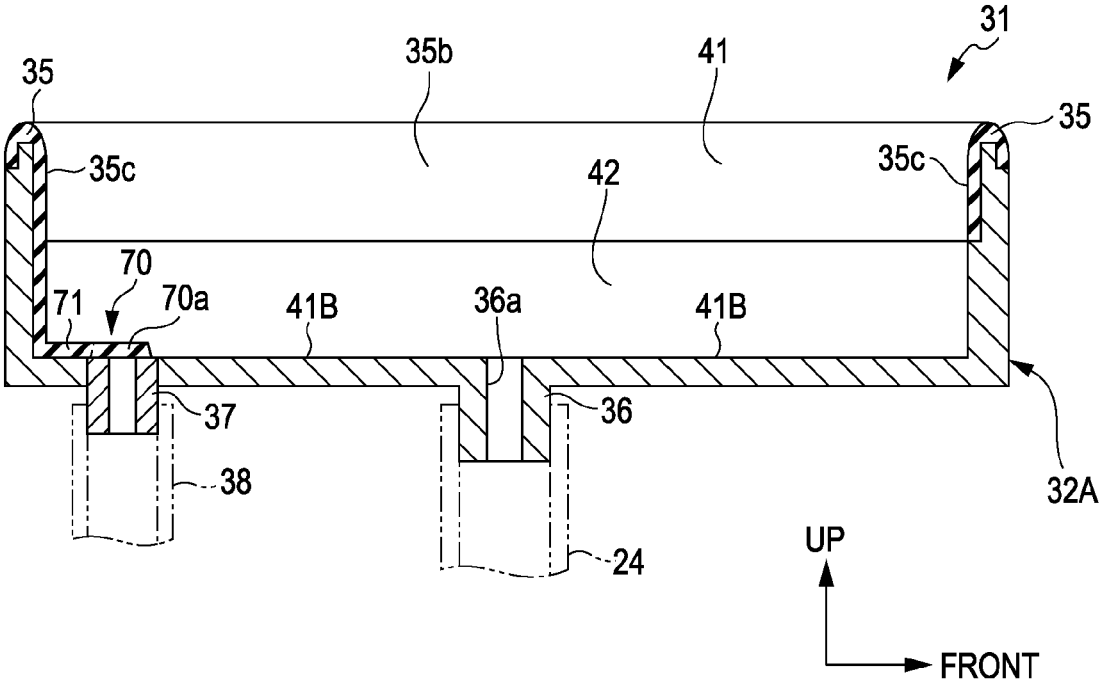
FIG. 14 is a cross-sectional view showing a modified structure of the cap provided with the check valve.

As shown in FIG. 14, the cap 31 in this modification forms a single substantially parallelepiped space including the first space 41 and the second space 42 placed one on top of another in the vertical direction. Then, in this modification, the first bottom portion 41B is formed as one of bottom portions in the cap 31. The waste liquid disposal port 36*a* is formed on the first bottom portion 41B at a center portion thereof. The first bottom portion 41B is formed of a substantially flat plane or, although not shown, an inclined surface inclining downward from the side wall side in the periphery toward the waste liquid disposal port 36*a*.

In this modification, the coupling portion 71 is formed in such a manner that part of the short pending wall portions 35*c* on the back side of the cap seal portion 35 extends downward in the band shape and the band-shaped portion extends continuously from the upper surface of the first bottom portion 41B. By the formation of the coupling portion 71, a member is continued in a band shape between the cap seal portion 35 and the valve portion 70*a* (the check valve 70). Therefore, in the same manner as the embodiment described above, the cap seal portion 35 and the check valve 70 can be molded simultaneously by the molding process. Then, after the molding of the check valve 70, the cap 31 is formed by the fixation of the air intake portion 37 to the cap body 32A in the same manner as the embodiment described above.

In the modification described above, it is also possible to form the check valve 70 and the cap seal portion 35 by the molding process in a state in which the coupling portion 71 which couples the check valve 70 and the cap seal portion 35 is not formed. When the coupling portion 71 cannot be provided, for example, the check valve 70 and the cap seal portion 35 can be molded simultaneously by providing the gate GT, respectively.

In the embodiment described above, the position where the check valve 70 is to be provided is not limited to the first bottom portion 41B. The check valve 70 may be provided, for example, on the long side walls 34, the short side walls 33, or the second bottom portion 42B as long as it is a position where the effects of the check valve 70 can be obtained.

In the modification described above, the check valve 70 is not limited to the configuration described above. For example, when the valve portion 70*a* may has a valve configuration of a shutter type which slides in the direction of the plane of the first bottom portion 41B by a drive unit (for example, an actuator) to open and close the air intake port 37*a*.

In the embodiment described above, the shape of the waste liquid disposal port 36*a* do not necessarily have to be the rectangular shape. For example, it may be an elongated circle shape, a circular shape, or an oval shape.

In the embodiment described above, the height of the formed rib 40 is not necessarily limited to be the same dimension as the height H2 of the first bottom portion 41B, and may be higher or lower than the height of the first bottom portion 41B.

In the embodiment described above, the height H1 of the communicating hole 46 is not necessarily limited to substantially half the height H2 of the rib 40, and may be higher or lower than the half the height H2.

In the embodiment described above, the second space 42 does not necessarily have to be disposed at a center of the first space 41 so as to overlap therewith. For example, the second space 42 may be shifted either forward or backward. Originally, in this case, since the ink absorber 50 becomes asymmetry in the fore-and-aft direction, the orientation is generated when being inserted into the cap 31.

In the embodiment described above, the rib 40 is not necessarily extended in the short direction (the left and right direction) at a center position in the longitudinal direction. For example, when the farthest portions 42*b* of the second bottom portion 42B are formed at positions shifted from the center of the second bottom portion 42B, a portion of the long side walls 34 which may be inclined inward is shifted from the center in the fore-and-aft direction according to the position of formation of the farthest portions 42*b*. Therefore, the rib 40 is preferably formed according to the position of generation of the shifted inward inclination.

In the embodiment described above, the length L2 of the second space 42 in the fore-and-aft direction may be the same dimension as the length L1 of the first space 41. In other words, the cap 31 may have a bottomed box shape having the side walls extending in the fore-and-aft direction formed continuously in the vertical direction without any level difference without being formed with the first bottom portion 41B in the first space 41. In this configuration, the ink absorbing amount of the ink absorber 50 is increased in comparison with the case of the embodiment described above, and the similar effects as the embodiments and the modifications described above can be obtained.

In the embodiment described above, the triangular cut-shaped portion may not be provided on the lower end side of the slit 53. If the displacement between the slit 53 and the rib 40 hardly occurs when inserting the ink absorber 50 into the cap 31, such a cut-shaped portion does not have to be provided.

In the embodiment described above, the width We of the waste liquid disposal port 36*a* in the fore-and-aft direction may be a dimension smaller than the width Wr of the rib 40 in the fore-and-aft direction. Even with the rib 40 having such a form, the communicating hole 46 can be formed so as to penetrate to the waste liquid disposal port 36*a* by using, for example, a (partly) slide-type meal mold. Also, the width Wf of the communicating hole 46 in the left and right direction may be a dimension larger than the width We of the waste liquid disposal port 36*a* in the left and right direction. In this embodiment, even when the width Wf of the communicating hole 46 in the left and right direction is the same as the width W1 of the rib 40 in the left and right direction, the communicating hole 46 is regarded as the communicating hole. Therefore, as long as at least part of the rib 40 is extended to a position overlapped two-dimensionally with the waste liquid disposal port 36*a* when viewed from above, the communicating hole 46 communicating with the waste liquid disposal port 36*a* can be formed by devising the structure of the metal mold.

In the embodiment described above, the capping device 30 does not necessarily have to be provided with the ink absorber 50. For example, when the ink ejected from the cap 31 is received by the cap 31 without flying around, the ink absorber 50 is not necessarily have to be provided.

In the embodiment described above, the liquid ejecting apparatus is embodied in the ink jet printer 11. However, it may also be embodied in a liquid ejecting apparatus which ejects or discharges liquid other than ink. The liquid ejecting apparatus in this embodiment may be applied to various liquid ejecting apparatuses including a liquid ejecting head for discharging a minute amount of liquid drop. The term "liquid drop" indicates the state of liquid discharged from the liquid ejecting apparatus, and includes a particle state, a tear drop state, and a thread state. The liquid herein may be any material as long as the liquid ejecting apparatus is able to eject. For example, it may be a substance in the state of liquid phase, and includes not only a liquid state substance having a high or low viscosity, a fluid-state substance such as inorganic solvent such as sol and gel water, organic solvent, solution, liquid state resin, liquid-state metal (melted metal), or liquid as a state of the substance, but also those obtained by dissolving, dispersing, or mixing particles of functional material formed of solid state substance such as pigment or metal particles in solvent. Representative examples of the liquid include the ink as described in the embodiment and liquid crystal. The term "ink" here includes various liquid compositions such as general water-based ink, oil-based ink, gel ink, hot-melt ink. Detailed examples of the liquid ejecting apparatus include liquid ejecting apparatuses which ejects liquid containing materials such as electrode material or colorant in the form of dispersion or dissolution used for manufacturing liquid crystal displays, EL (electroluminescence) displays, surface emission-type displays, or color filters. Alternatively, the liquid ejecting apparatus in the invention may include a liquid ejecting apparatus configured to eject biological organic substances used in manufacture of biochips, a liquid ejecting apparatus, a textile printing apparatus, or a micro dispenser used as a precision pipette and configured to eject liquid as a sample. Furthermore, a liquid ejecting apparatus configured to eject lubricant for pinpoint lubrication for precise machines such as watches or cameras, a liquid ejecting apparatus configured to eject transparent resin liquid such as UV-cured resin on a substrate for forming a micro-semispherical lens (optical lens) used for optical communication elements or the like, and a liquid ejecting apparatus configured to eject etching liquid such as acid or alkali for etching the substrate or the like may be employed. The invention may be applied to any one of these liquid ejecting apparatuses.

What is claimed is:

1. A capping device comprising:

a box-shaped cap having an opening at one end of a side wall formed into a ring shape and a bottom portion;

a liquid absorber configured to absorb a liquid;

a waste liquid disposal port that is provided in the bottom portion and configured to discharge liquid flowed therein from the opening;

a rib connecting two opposing wall surfaces of the side wall in an extending direction between the two opposing wall surfaces, the rib being formed integrally with the two opposing wall surfaces; and a communicating hole formed in the rib, the communicating hole penetrating the rib in the a width direction and intersecting the extension direction of extension of the rib between the two opposing wall surfaces, the communicating hole being in communication with the waste liquid disposal port, wherein the liquid absorber is accommodated in the box-shaped cap so as to cover a top of the rib from the opening side of the box-shaped cap.

2. The capping device according to claim 1, wherein the waste liquid disposal port has a diameter at least larger than or the same as the dimension of the rib in the width direction.

3. The capping device according to claim 1, wherein the liquid absorber is accommodated in the box-shaped cap and formed with comprises a slit formed by incising at a position corresponding to the rib.

4. The capping device according to claim 3, wherein the slit is provided to have a width not exceeding the width of the rib.

5. The capping device according to claim 3, wherein the liquid absorber is provided with a cut-shaped portion cut into a triangular shape at an end portion where the incision of the slit is started.

6. The capping device according to claim 3, wherein the liquid absorber is provided with a rectangular cut-shaped portion having a width not smaller than the width of the rib at an end portion on the side of terminal of the incision of the slit.

7. The capping device according to claim 1, wherein the bottom portion includes a second bottom portion having a portion farthest from the opening and a first bottom portion formed of a portion closer to the opening than the second bottom portion, and the rib is provided at a farthest portion from the opening on the second bottom portion.

8. The capping device according to claim 7, wherein the second bottom portion is formed between two of the first bottom portions formed apart from each other, and inclined surfaces are formed respectively between the second bottom portion and two of the first bottom portions so that the distance therebetween is decreased toward the second bottom portion.

9. The capping device according to claim 1, comprising:

a communicating port to which a vacuum unit configured to vacuum the interior of the cap is connected and which communicates the interior of the cap with outside air out of the cap; and a check valve formed on a surface which forms the cap and configured to inhibit a movement of the liquid from the interior of the cap to the outside air via the communicating port and allows the movement of air from the outside air to the interior of the cap via the communicating port after the interior of the cap has vacuumed by the vacuum unit.

10. The capping device according to claim 9, wherein the check valve includes a fixed portion fixed to the cap and a movable portion displaced between a covered position covering and closing the communicating port from the inside of the cap and an open position away from the covered position and opening the communicating port.

11. The capping device according to claim 10, further comprising a cap seal portion which comes into abutment with the liquid ejection head and the check valve is formed of the same material as the cap seal portion.

12. A liquid ejecting apparatus comprising a liquid ejecting head configured to eject liquid to a medium and the capping device according to claim 1.

13. A liquid ejecting apparatus comprising a liquid ejecting head configured to eject liquid to a medium and the capping device according to claim 3.

14. A liquid ejecting apparatus comprising a liquid ejecting head configured to eject liquid to a medium and the capping device according to claim 4.

15. A liquid ejecting apparatus comprising a liquid ejecting head configured to eject liquid to a medium and the capping device according to claim 5.

16. A liquid ejecting apparatus comprising a liquid ejecting head configured to eject liquid to a medium and the capping device according to claim 6.

17. The capping device according to claim 1, wherein the liquid absorber is disposed inside the box-shaped cap but outside of the communicating hole and wherein the liquid absorber exerts a force on both sides of the rib in the width direction.

18. The capping device according to claim 1, wherein the liquid absorber is disposed inside the box-shaped cap but outside of the communicating hole, and wherein the bottom portion is configured to guide the liquid absorber towards the waste liquid disposal port.

* * * * *